US005427897A

United States Patent [19]

Nakamura et al.

[11] Patent Number: 5,427,897

[45] Date of Patent: Jun. 27, 1995

[54] METHOD FOR PROCESSING SILVER HALIDE COLOR PHOTOGRAPHIC MATERIAL

[75] Inventors: Koichi Nakamura; Masato Taniguchi, both of Kanagawa, Japan

[73] Assignee: Fuji Photo Film Co., Ltd., Japan

[21] Appl. No.: 17,386

[22] Filed: Feb. 12, 1993

[30] Foreign Application Priority Data

Feb. 14, 1992 [JP] Japan ..... 4-059123

[51] Int. Cl.[6] ..... G03C 7/46

[52] U.S. Cl. ..... 430/384; 430/385; 430/372; 430/434; 430/435; 430/441; 430/442; 430/464; 430/484; 430/558

[58] Field of Search ..... 430/384, 385, 558, 434, 430/435, 441, 442, 464, 484, 372

[56] References Cited

U.S. PATENT DOCUMENTS

| | | | |
|---|---|---|---|
| 4,873,183 | 10/1989 | Tachibana et al. | 430/550 |
| 4,910,127 | 3/1990 | Sakaki et al. | 430/546 |
| 5,102,778 | 4/1992 | Nakamura | 430/393 |
| 5,176,987 | 1/1993 | Nakamura et al. | 430/351 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0249453 | 10/1987 | European Pat. Off. . |
| 0488248 | 6/1992 | European Pat. Off. . |
| 2149844 | 6/1990 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A method for processing an imagewise exposed silver halide color photographic material comprising a support having thereon at least a silver halide emulsion layer containing a cyan dye-forming coupler, a silver halide emulsion layer containing a magenta dye-forming coupler, and a silver halide emulsion layer containing a yellow dye-forming coupler: wherein the silver halide color photographic material contains at least one cyan dye-forming coupler represented by the following general formula (I) or (II) in the silver halide emulsion layer containing the cyan dye-forming coupler: and wherein the processing comprises color developing the imagewise exposed silver halide color photographic material with a color developer containing a p-phenylenediamine derivative represented by the following general formula (III):

(I)

(II)

(III)

wherein the substituents are defined herein the specification.

12 Claims, No Drawings

METHOD FOR PROCESSING SILVER HALIDE COLOR PHOTOGRAPHIC MATERIAL

FIELD OF THE INVENTION

The present invention relates to a method for processing a color photographic light-sensitive material comprising a light-sensitive silver halide and a coupler such as color paper. More particularly, the present invention relates to a rapid color development process which can provide an image having a high dye stability with an excellent processing stability and with little deterioration of images after prolonged storage.

BACKGROUND OF THE INVENTION

The processing of a silver halide color photographic material essentially comprises three steps, i.e., development (in the case of color reversal material, black-and-white development is conducted before color development), desilvering and rinse. The desilvering process comprises a bleach and fixing or a combined bleach and fixing step. In addition to these steps, additional processing steps such as stabilizing, prebath processing before each step and stop step may be used. In color development, silver halides which have been exposed to light are reduced with a color developing agent to produce silver and halogen ions. At the same time, the color developing agent thus oxidized reacts with a coupler to form a dye. Therefore, when a large amount of a silver halide photographic material is continuously processed with an automatic developing machine or the like, halogen ions accumulate in the developer. In recent years, there has been a positive tendency to reduce the replenishment rate for the purpose of saving resources and preventing environmental pollution.

However, if the replenishment rate of the developer is reduced thoughtlessly, the resulting accumulation of substances eluted from the photographic light-sensitive material, particularly iodine ion and bromine ion, causes the development activity to drop and this impairs the rapidity of the processing. As an approach for solving this problem, a method which comprises raising the pH of the developer and the processing temperature may be used. However, this approach is disadvantageous because great fluctuations of photographic properties and deterioration in the stability of the developer during continuous processing occur. Further, for the purpose of eliminating the accumulation of iodine ion or bromine ion, which is a strong development inhibitor, to expedite the processing, JP-A-68-95345, JP-A-59-232342, and JP-A-61-70552 (the term "JP-A" as used herein means an "unexamined published Japanese patent application"), and WO 87-04534 disclose a method which comprises the use of a silver halide color photographic material having a high silver chloride content. This method is regarded as an effective means of enabling rapid processing even with a reduced developer replenishment rate.

However, with a color developer comprising 4-amino-3-methyl-N-ethyl-N-β-methanesulfonamidoethyl aniline, which is a conventional developing agent, it is difficult to maintain the stability of the processing solution and accomplish an ultrarapid processing within 30 seconds or less while achieving stable photographic properties during continuous processing. In other words, it has been found that although a silver halide photographic material having a high silver chloride content can be rapidly processed with a high pH developer or a high temperature developer, a marked deterioration in the stability of the processing solution as well as in processing stability occur, making it impossible to put this system into practical use. Further, an approach for suppressing the fluctuations of the photographic properties due to the accumulation of bromine ions during the development of a silver halide photographic material mainly comprising silver bromochloride's, a method which comprises use of an N-hydroxyalkyl-substituted p-phenylenediamine derivative is disclosed in JP-A-61-261740, and JP-A-61-275837. These patent specifications describe that if the color development is effected in a short period of time to reduce the remaining amount of a color developing agent in the photographic light-sensitive material, the resulting dye exhibits improved storage stability.

On the other hand, it is said that if a hydroxyalkyl-substituted p-phenylenediamine derivative is used, the resulting developed dye exhibits a remarkably deteriorated storage stability, particularly fastness to light. In fact, when a photographic light-sensitive material comprising a silver halide emulsion having 80 mol % or more of silver chloride is processed with a color developer containing 4-amino-3-methyl-N-ethyl-N-β-hydroxyethylaniline and without benzyl alcohol, an image can be rapidly formed (in 30 seconds) with an excellent processing stability. It was, however, found that despite the short time processing, the resulting image exhibits a poorer light fastness than with 4-amino-3-methyl-N-ethyl-N-β-methanesulfonamidoethyl-aniline. Further, British Patent 807,899 discloses that the use of a certain kind of an N-hydroxyalkyl-substituted p-phenylenediamine derivative provides an excellent cyan dye storage stability. However, this is attributed to the fact that the color development is effected over a long period of time. Thus, cyan dye preservability can be further improved. However, on the contrary, yellow and magenta dye preservability is deteriorated. Therefore, the image which has been stored is remarkably poorly-balanced and thus is not worth seeing.

At present, low replenishment processing and ultrarapid processing are keenly desired by those skilled in the art. As mentioned above, the present situation is that if both of these two requirements are met, another problem arises that the resulting dye exhibits some degree of deterioration in storage stability, particularly fastness to light. In other words, a dye image developed from the above described 4-amino-3-methyl-N-ethyl-N-β-hydroxyethylaniline exhibits a drastically deteriorated light fastness. U.S. Pat. No. 5,176,987 discloses that this problem can be solved by use of a developing agent having a specific chemical structure. In other words, the disclosure is that the fastness of developed dye to light can be drastically enhanced while maintaining the rapidity of processing merely by replacing the hydroxyethyl group in 4-amino-3-methyl-N-ethyl-N-β-hydroxyethylaniline with a hydroxypropyl group or a hydroxybutyl group. However, it was found that if the image is stored under high humidity conditions, a deterioration in the resolving power or stain increase on the cyan image easily occur. In particular, these problems become particularly marked when the desilvering time and rinse time after development are both reduced, making it impossible to fully remove the processing solution components.

In the prior art, phenolic or naphtholic cyan coupler have been used as a cyan coupler for the formation of a cyan color image.

These cyan couplers are used in a process which comprises the reaction of an aromatic primary amine color developing agent oxidized with exposed silver halide as an oxidizing agent, with couplers to form indophenol, indoaniline, indamine, azomethine, phenoxadine, phenadine dyes and analogous dyes, i.e., substractive color image formation process, normally a color image formation process which comprises changing the amount of the three color dyes, i.e., yellow, magenta and cyan, produced to form a color image.

However, these phenolic or naphtholic cyan couplers have a great disadvantage because they have an undesirable absorption in the green light range and blue light range, and this markedly deteriorates blue or green color reproducibility. It has been keenly desired to solve this problem.

Use of 2,4-diphenylimidazole cyan couplers as described in EP 249,453A2 have been proposed as a means of solving this problem. It is true that dyes developed from these couplers exhibit less undesirable absorption in the green light range and blue light range than conventional dyes and thus are advantageous in color reproduction. However, even these couplers leave much to be desired in color reproducibility. Further, these couplers have further disadvantages because they exhibit a low reactivity with the oxidation product of a developing agent, i.e., coupling reactivity, and the dyes thus developed exhibit a remarkably low fastness to heat and light. Thus, these couplers cannot be used practically.

Moreover, pyrazoloazole cyan couplers as described in U.S. Pat. No. 4,873,183 exhibit less undesirable absorption in the green light range and the blue light range than the conventional dyes but similarly leave much to be desired in color reproducibility. These cyan couplers have another problem that they exhibit a remarkably low color developability.

Further, if a photographic light-sensitive material comprising these cyan couplers is rapidly processed, color reproducibility and coloring properties are deteriorated in comparison with conventional processing comprising a long time color development step.

SUMMARY OF THE INVENTION

Therefore, an object of the present invention is to provide a method for processing a color photographic light-sensitive material which provides a color image with well-developed dyes and little stain after prolonged storage.

Another object of the present invention is to provide a method for the ultrarapid development of a color photographic light-sensitive material with a color developing agent, which provides a color image with little fluctuations of photographic properties during continuous processing, an excellent image resolving power even after prolonged storage and little stain on a white background.

A further object of the present invention is to provide a processing method which enables the reduction of, optionally the elimination of, waste color developer as well as stable color development in a short period of time.

Using a silver halide with a high silver chloride content, ultrarapid development was studied using various p-phenylenediamine derivatives. As a result, it was unexpectedly found that when a color photographic light-sensitive material comprising a cyan dye-forming coupler as defined in the present invention is processed with a developer containing a specific color developing agent as defined in the present invention, an image can be obtained with no deterioration in the image resolving power and little stain even after prolonged storage under high humidity conditions while providing excellent processing stability and rapidity even at a reduced replenishment rate.

These and other objects of the present invention will become more apparent from the following detailed description and examples.

These objects of the present invention are accomplished by a method comprising processing an imagewise exposed silver halide color photographic material comprising a support having thereon at least a silver halide emulsion layer containing a cyan dye-forming coupler, a silver halide emulsion layer containing a magenta dye-forming coupler, and a silver halide emulsion layer containing a yellow dye-forming coupler, wherein the silver halide color photographic material contains at least one cyan dye-forming coupler represented by the following general formula (I) or (II)

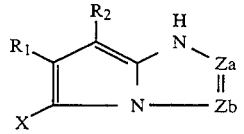

(I)

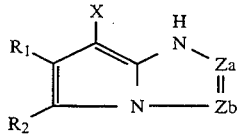

(II)

wherein Za and Zb each represents —C($R_3$)= or —N=, with the proviso that one of Za and Zb is —N= and the other is —C($R_3$)=; $R_1$ and $R_2$ each represents an electrophilic group having a Hammett's substituent constant $\sigma_p$ of 0.02 or more, with the proviso that the sum of $\sigma_p$ of $R_1$ and $R_2$ is 0.65 or more; $R_3$ represents a hydrogen atom or a substituent; X represents a hydrogen atom or a group capable of being released upon coupling with the oxidation product of an aromatic primary amine color developing agent; and $R_1$, $R_2$, $R_3$ or X may be a divalent group which forms a dimer or higher polymer or a high molecular weight chain to form a homor polymer or copolymer; in the silver halide emulsion layer containing a cyan dye-forming coupler and wherein said processing comprises color developing said imagewise exposed silver halide color photographic material with a color developer containing a p-phenylenediamine derivative represented by the following general formula (III):

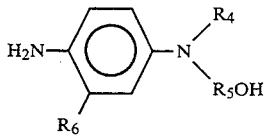

(III)

wherein $R_4$ represents a $C_{1-6}$ straight-chain or branched alkyl group (i.e., having 1 to 6 carbon atoms) or $C_{3-6}$ straight-chain or branched hydroxyalkyl group; $R_5$ represents a $C_{3-6}$ straight-chain or branched alkylene group or $C_{3-6}$ straight-chain or branched hydroxyalkylene group; and $R_6$ represents a hydrogen atom, $C_{1-4}$ straight-chain or branched alkyl group or $C_{1-4}$ straight-chain or branched alkoxy group.

These objects of the present invention are also accomplished by a process for processing of an imagewise exposed silver halide color photographic material as defined above, wherein the processing time of the photographic material comprises 25 seconds or less for blix step, and the time from the beginning of development step to the completion of drying step being 120 seconds or less. The silver halide to be incorporated in the silver halide emulsion layer preferably has a silver chloride content of 90 mol % or more. Further, the replenishment rate of the color developer is preferably in the range of 120 ml or less, more preferably 15 ml to 60 ml per $m^2$ of light-sensitive material.

In a preferred embodiment of the present invention, the processing may be effected without replenishment (the evaporative loss of water content may be replenished).

The term "development time" as used herein means the "time during which the light-sensitive material stays in the developer".

As a result of extensive study, it has now been found that the use of specific color developing agents described in British Patent 807,899 and European Patent 410,450A2 enables an ultra-rapid processing with little fluctuations of photographic properties under running conditions and provides an image having a high dye fastness. However, if the image is allowed to stand under the circumstances of high humidity for a prolonged period of time, a reduction in the resolving power as well as stain increase are inevitable. It has been found that these difficulties can easily take place particularly when the processing time is as short as 25 seconds or less if desilvering is effected at the blix step. It was found that this problem can be unexpectedly solved by the use of a photographic light-sensitive material comprising a cyan dye-forming coupler represented by the general formula (I) or (II).

Couplers containing a 1H-pyrrolo[1,2-b][1,2,4]-triazole nucleus which are heretofore known are described in the digest of speeches presented at the 1985 Annual Conference (held at Shigaku Kaikan on May 23, 1985), of the Society of Photographic Science and Technology of Japan pp. 108–110, and JP-A-62-279340, and JP-A-62-278552. However, they are all known as magenta couplers. Dyes formed by pyrrolotriazole couplers described in the digest of speeches of 1985 Annual Conference of Society of Photographic Science and Technology of Japan exhibit a slightly wider absorption spectrum than dyes formed by well-known pyrrolotriazole magenta couplers and thus cannot be said to exhibit a satisfactory hue as magenta couplers.

Further, couplers containing a pyrrolotriazole nucleus are also described in JP-A-62-291646 and JP-A-63-32548. It is obvious that these couplers, too, are described as magenta couplers. Compounds exemplified in these patents are all limited to magenta dye-forming couplers.

By contrast, the present invention is directed to cyan couplers containing a 1H-pyrrolo[1,2-b][1,2,4]-triazole nucleus. The nucleus of these cyan couplers is similar to that of the above mentioned magenta couplers but differ from the above mentioned magenta couplers in structure, purpose and effect.

DETAILED DESCRIPTION OF THE INVENTION

The present invention is further described in greater detail hereinafter.

The general formulae (I) and (II) are described below.

Za and Zb each represents —C($R_3$)= or —N=, with the proviso that one of Za and Zb is —N= and the other is —C(Rs)=.

In particular, the cyan coupler of the present invention can be more specifically represented by the following general formula (I-a), (I-b), (II-a) or (II-b):

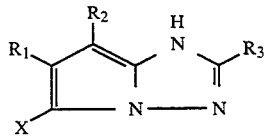
(I-a)

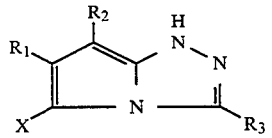
(I-b)

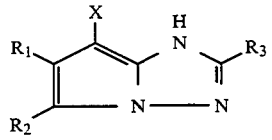
(II-a)

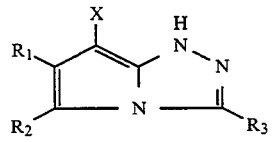
(II-b)

wherein $R_1$, $R_2$, $R_3$ and X are as defined in the general formula (I) or (II).

$R_3$ represents a hydrogen atom or a substituent. Examples of suitable substituents include a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, and an azolyl group. These substituents may be further substituted by substituents described with reference to $R_3$.

More particularly, $R_3$ represents a hydrogen atom, a halogen atom (e.g., chlorine, bromine ), an alkyl group (e.g., a $C_{1-32}$ straight-chain or branched alkyl group, an aralkyl group, an alkenyl group, an alkynyl group, a cycloalkyl group, a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-

(4-hydroxyphenylsulfonyl)phenoxy]dodecanamide} phenyl}-propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecanamidephenyl), a heterocyclic group (e.g., 2-furyl, 2-chenyl, 2-pyrimidinyl, 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamide, benzamide, tetradecanamide, 2-(2,4-di-t-amylphenoxy)-butanamide, 4-(3-t-butyl-4-hydroxyphenoxy)butanamide, 2-{4-(4-hydroxyphenylsulfonyl)phenoxy}decanamide), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-{2-(3-t-butyl-4-hydroxyphenoxy)-dodecanamido}anilino), a ureide group (e.g., phenylureide, methylureide, N,N-dibutylureide), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidephenylthio), an alkoxycarbonylamino group (e.g., methoxycarbonylamino, tetradecyloxycarbonylamino), a sulfonamide group (e.g., methanesulfonamide, hexadecansulfonamide, benzenesulfonamide, p-toluenesulfonamide, octadecanesulfonamide, 2-methoxy-5-t-butylbenzenesulfonamide), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylamino-phenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imide group (e.g., N-succinimide, N-phthalimide, 3-octadecenylsuccinimide), a heterocyclic thio group (e.g., 2-benzothiazolylthio, 2,4-di-phenoxy-l,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-il, triazolyl).

Preferred examples of $R_3$ include an alkyl group, an aryl group, a heterocyclic group, a cyano group, a nitro group, an acylamino group, a anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

Preferred of these groups are an alkyl group and an aryl group. From the standpoint of cohesiveness of produced cyan dyes upon the coupling reaction, an alkyl group and an aryl group containing at least one substituent are particularly preferred. More preferably, an alkyl group or an aryl group containing at least one alkoxy group, sulfonyl group, sulfamoyl group, carbamoyl group, acylamide group or sulfonamide group as a substituent is used. Particularly preferably, an alkyl group or an aryl group containing at least one acylamide group or sulfonamide group as a substituent is used. In the aryl group, such a substituent is preferably in at least the ortho position.

The cyan coupler of the present invention contains $R_1$ and $R_2$ which each represents an electrophilic group having a $\sigma_p$ of 0.20 or more, with the proviso that the sum of $\sigma_p$ of $R_1$ and $R_2$ is 0.65 or more, to develop a cyan image. The sum of $\sigma_p$ of $R_1$ and $R_2$ is preferably 0.70 or more. The upper limit of the sum of $\sigma_p$ of $R_1$ and $R_2$ is about 1.8.

$R_1$ and $R_2$ each represents an electrophilic group having a Hammett's substituent constant $\sigma_p$ of 0.20 or more, preferably 0.30 or more. The upper limit of the Hammett's substituent constant $\sigma_p$ of each of $R_1$ and $R_2$ is 1.0 or less. Hammett's rule is an empirical rule which was proposed in 1935 by L. P. Hammtt to provide a quantative discussion of the effect of substituents on reaction or equilibrium of benzene derivatives. This rule is now widely accepted.

Substituent constants determined by Hammett's rule include $\sigma_p$ value and $\sigma_m$ value which can be found in many general references, e.g., J. A. Dean, "Lange's Handbook of Chemistry", vol. 12 1979 (McGraw-Hill), and "Kagaku no Ryoiki (The Domain of Chemistry)", extra edition, No. 122, pp. 96–103, 1979 (Nankodo). In the present invention, $R_1$ and $R_2$ are defined by Hammett's substituent constant $\sigma_p$. However, this does not mean that these substituents are limited to those having known $\sigma_p$ values found in the above cited references. Even substituents exhibiting these $\sigma_p$ values but not described in any reference are suitable.

Specific examples of $R_1$ and $R_2$ as an electrophilic group having $\sigma_p$ of 0.20 or more include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate, a thiocarbonyl group, a halogenated alkyl group, a halogenated alkoxy group, a halogenated aryloxy group, a halogenated alkylamino group, a halogenated alkylthio group, an aryl group substituted by other electrophilic groups having a $\sigma_p$ of 0.20 or more, a heterocyclic group, a halogen atom, an azo group, and a selenocyanate group.

Of these substituents, those which can further contain substituents may further contain substituents described with reference to $R_3$.

Referring further to $R_1$ and $R_2$, examples of electrophilic groups having a $\sigma_p$ of 0.20 or more include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-t-amylphenoxy)propyl}carbamoyl), an alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl), an aryloxycarbonyl group (e.g., phenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluensulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenated alkyl group (e.g., trifluoromethane, heptafluoropropane), a halogenated alkoxy group (e.g., trifluoromethyloxy), a halogenated aryloxy group (e.g., pentafluorophenyloxy), a halogenated alkylamino group (e.g., N,N-di-(trifluoromethyl)amino), a halogenated alkylthio group (e.g., difluoromethylthio, 1,1,2,2-tetrafluoroethylthio), an aryl group substituted with other electrophilic groups having a $\sigma_p$ of 0.20 or more (e.g., 2,4-dinitrophenyl, 2,4,6-trichlorophenyl, pentachlorophenyl), a heterocyclic group (e.g., 2-benzoxazolyl, 2-benzothiazolyl, 1-phenyl-2-benzimidazolyl, 5-chloro-1-tetrazolyl, 1-pyrrolyl), a halogen atom (e.g., chlorine, bromine), azo group (e.g., phenylazo), and selenocyanate group. Of these substituents, those which can further contain substituents may further contain substituents described with reference to $R_3$.

Preferred examples of $R_1$ and $R_2$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted with two or more other electrophilic groups having a $\sigma_p$ of 0.20 or more, and a heterocyclic group. Preferred of these groups are an acyl group, an alkoxycarbonyl group, a nitro group, a cyano group, an arylsulfonyl group, a carbamoyl group, and a halogenated alkyl group.

$R_1$ is most preferably a cyano group. $R_2$ is particularly preferably an aryloxycarbonyl group or an alkoxycarbonyl group, most preferably a branched alkoxycarbonyl group or alkoxycarbonyl group containing an electrophilic group.

X represents a hydrogen atom or an atom or group capable of being released upon coupling reaction with the oxidation product of an aromatic primary amine color developing agent. Examples of suitable release atoms or groups include a halogen atom, an alkoxy group, an aryloxy group, an acyloxy group, an alkylsulfonyloxy group, an arylsulfonyloxy group, an acylamino group, an alkylsulfonamide group, an arylsulfonamide group, an alkoxycarbonyloxy group, an aryloxycarbonyloxy group, an alkylthio group, an arylthio group, a heterocyclic thio group, an alkylsulfinyl group, an arylsulfinyl group, a carbamoylamino group, a 5- or 6-membered nitrogen-containing heterocyclic group, an imide group, and an arylazo group. These groups may be substituted by groups described as substituents for $R_3$.

Specific examples of such release atoms or groups include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkylsulfonyloxy group and arylsulfonyloxy group (e.g., methanesulfonyloxy, toluenesulfonyloxy), an acylamino group (e.g., dichloroacetylamino, heptafluorobutyrylamino), an alkylsulfonamide group and an arylsulfonamide group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkylthio group, an arylthio group and a heterocyclic thio group (e.g., dodecylthio, 1-carboxydodecylthio, phenylthio, 2-butoxy-5-t-octylphenylthio, tetrazolylthio), an alkylsulfinyl group and an arylsulfinyl group (e.g., isopropylsulfinyl, phenylsulfinyl), a carbamoylamino group (e.g., N-methylcarbamoylamino, N-phenylcarbamoylamino), a 5- or 6-membered nitrogen-containing heterocyclic group (e.g., imidazolyl, pyrazolyl, triazolyl, tetrazolyl, 1,2-dihydro-2-oxo-1-pyridyl), an imide group (e.g., succinimide, hydantoinyl), and an arylazo group (e.g., phenylazo, 4-methoxyphenylazo). The release atom or group represented by X connected to the molecule via carbon atom may be in the form of bis type coupler obtained by the condensation of four-equivalent couplers with aldehydes or ketones. Further, X may contain photographically useful groups such as a development inhibitor and a development accecelerator.

Preferred examples of X include a halogen atom, an alkoxy group, an aryloxy group, an alkylthio group, an arylthio group, an alkylsulfinyl group, an arylsulfinyl group, and 5- or 6-membered nitrogen-containing heterocyclic group connected to the coupling active position via nitrogen atom. Preferred of these atoms or groups are a halogen atom, an alkylthio group, an arylthio group, an alkylsulfinyl group, and an arylsulfinyl group. Particularly preferred of these are an arylthio group and an arylsulfinyl group.

In the cyan coupler represented by the general formula (I) or (II), $R_1$, $R_2$, $R_3$ or X may be a divalent group which combines to or more coupler nuclei to form a dimer or higher polymer or a high molecular weight chain forming a homo polymer or a copolymer. A typical example of a homo polymer or copolymer formed by the connection of the divalent group to a high molecular weight chain is a homo polymer or copolymer of an addition polymer ethylenically unsaturated compound containing a cyan coupler residue represented by the general formula (I) or (II). In this case, one or more kinds of cyan color repeating unit containing a cyan coupler residue represented by the general formula (I) or (II) may be incorporated in the polymer. The copolymer may be one containing one or more kinds of noncoloring ethylenic monomers as copolymer components. The cyan color repeating unit containing a cyan coupler residue represented by the general formula (I) or (II) is preferably represented by the following general formula (P):

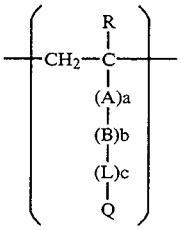

(P)

wherein R represents a hydrogen atom, a $C_{1-4}$ alkyl group or a chlorine atom; A represents —CONH—, —COO— or a substituted or unsubstituted phenylene group; B represents a substituted or unsubstituted alkylene group, phenylene group or aralkylene group; L represents —CONH—, —NHCONH—, —NHCOO—, —NHCO—, —OCONH—, —NH—, —COO—, —OCO—, —CO—, —O—, —S—, $—SO_2—$, $—NHSO_2—$ or $—SO_2NH—$; a, b, and c each represents an integer of 0 or 1; and Q represents a cyan coupler residue formed by removal of a hydrogen atom from $R_1$, $R_2$, $R_3$ or X in the compound represented by the general formula (I) or (II).

The polymer is preferably a copolymer of a cyan color monomer represented by the coupler unit of the general formula (I) or (II) and a noncoloring ethylenic monomer which does not couple with the oxidation product of an aromatic primary amine developing agent.

Examples of suitable noncoloring ethylenic monomers which do not couple with the oxidation product of an aromatic primary amine developing agent include acrylic acid, α-chloroacrylic acid, α-alkylacrylic acid (e.g., methacrylic acid), amides or esters derived from these acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate), vinylester (e.g., vinyl acetate, vinyl propionate, vinyl laurate), acrylonitrile, methacrylonitrile, aromatic vinyl compounds (e.g., styrene and derivatives thereof, such as vinyltoluene, divinylbenzene, vinylacetophenone, sulfostyrene), itaconic acid, citraconic acid, crotonic acid, vinylidene chloride, vinylalkyl ethers (e.g., vinylethyl ether), maleic ester, N-vinyl-2-pyrrolidone, N-vinylpyridine, 2-vinylpyridine, and 4-vinylpyridine.

Particularly preferred of these noncoloring ethylenic monomers are acrylic ester, methacrylic ester, and maleic ester. Two or more of these noncoloring ethylenic monomers can be used in combination of described. For example, methyl acrylate and butyl acrylate, butyl acrylate and styrene, butyl methacrylate and methacrylic acid, or methyl acrylate and diacetone acrylamide can be used in combination.

As is well known in the field of polymer couplers, the ethylenically unsaturated monomer copolymerized with the vinyl monomer corresponding to the general formula (I) or (II) can be selected such that the physical properties and/or chemical properties of the copolymer to be formed, such as solubility, compatibility with binder such as gelatin, flexibility, and thermal stability, can be advantageously affected.

In order to incorporate the cyan coupler of the present invention in the silver halide photographic material, preferably in the red-sensitive silver halide emulsion layer, it is preferably in the form of so-called coupler-in-emulsion type coupler. To this end, at least one of $R_1$, $R_2$, $R_3$ and X is preferably a so-called ballast group (preferably containing 10 or more carbon atoms, more preferably 10 to 50 carbon atoms).

In the present invention, a cyan coupler represented by the general formula (I) is preferred in view of spectral absorption properties. In particular, a cyan coupler repre-sented by the general formula (I-a) is preferred in the light of effect.

Specific examples of couplers of the present invention are set forth below, but the present invention should not be construed as being limited thereto.

(C-1)

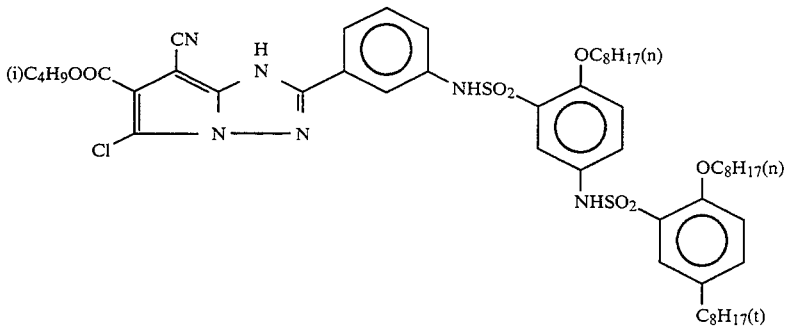

-continued
(C-2)
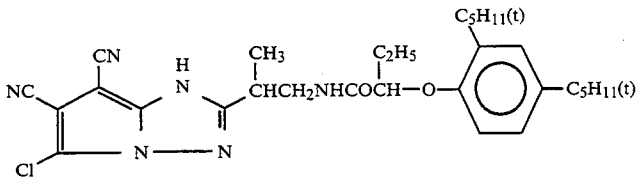
(C-3)
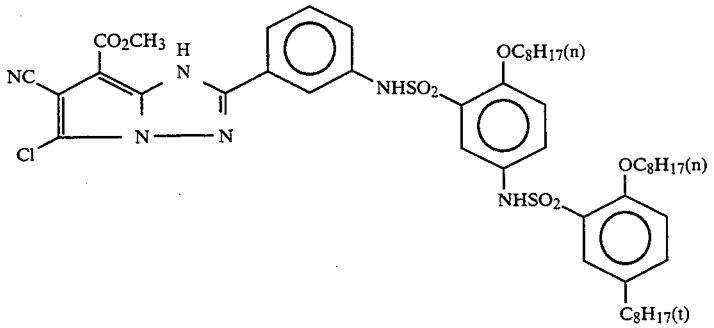
(C-4)
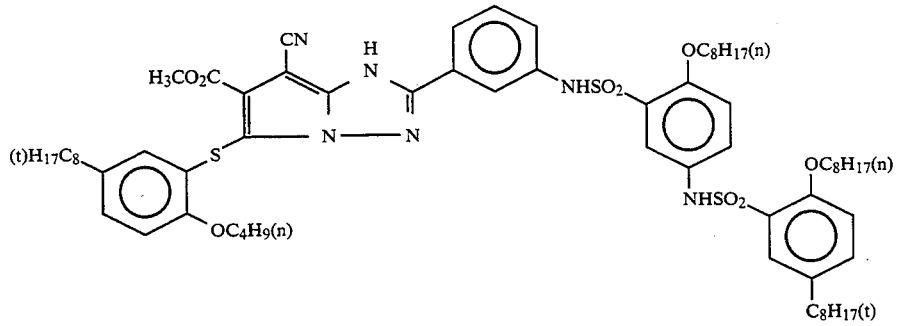
(C-5)
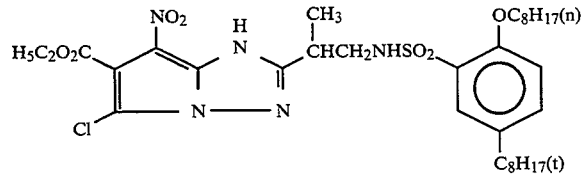
(C-6)
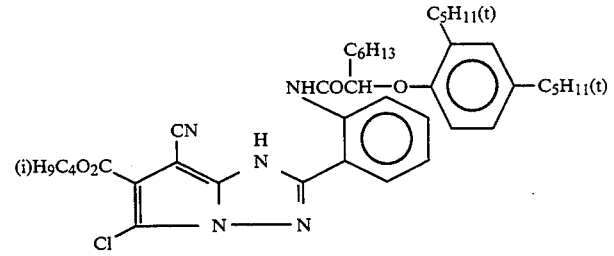
(C-7)
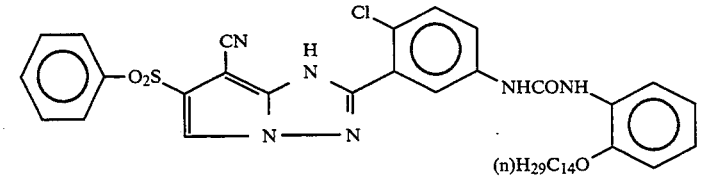
(C-8)
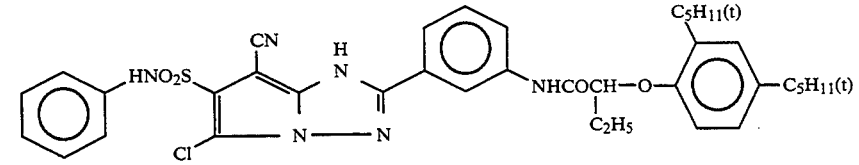

-continued
(C-9)
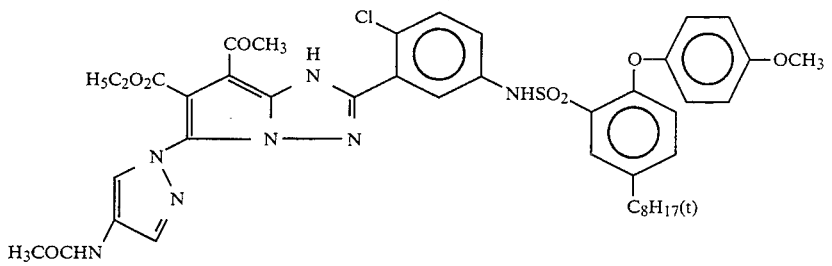
(C-10)
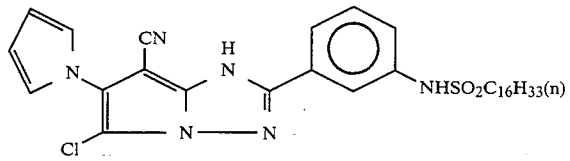
(C-11)
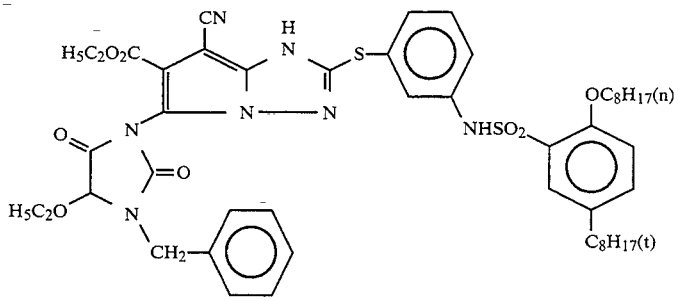
(C-12)
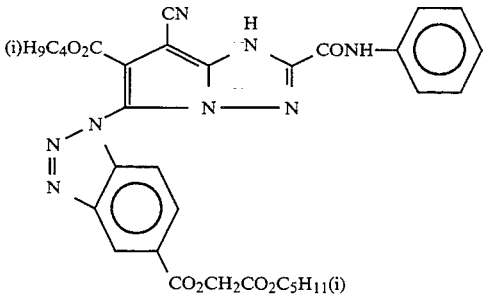
(C-13)
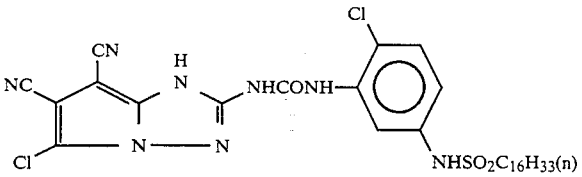

-continued
(C-14)
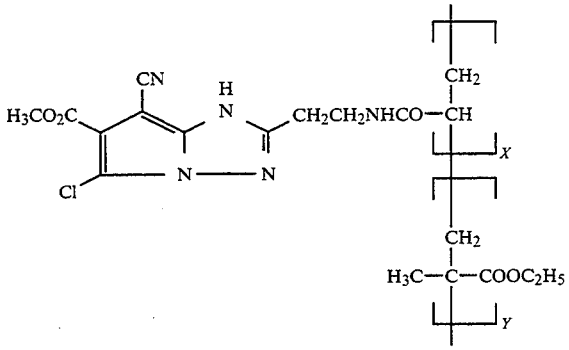
X:Y = 50:50
(C-15)
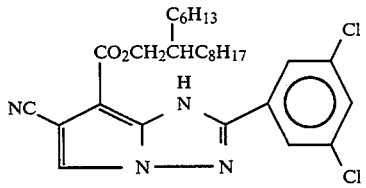
(C-16)
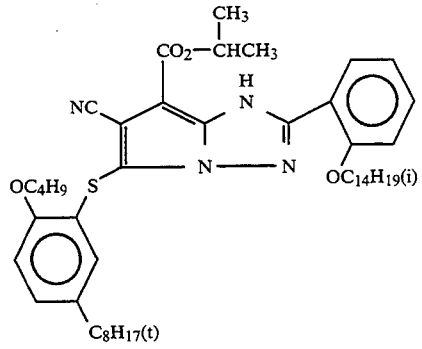
(C-17)
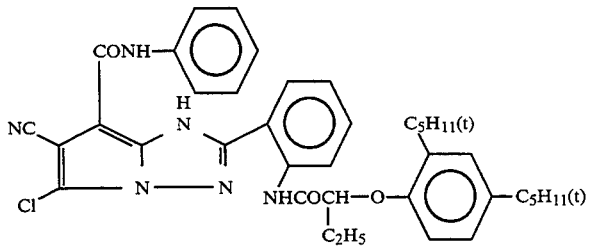
(C-18)
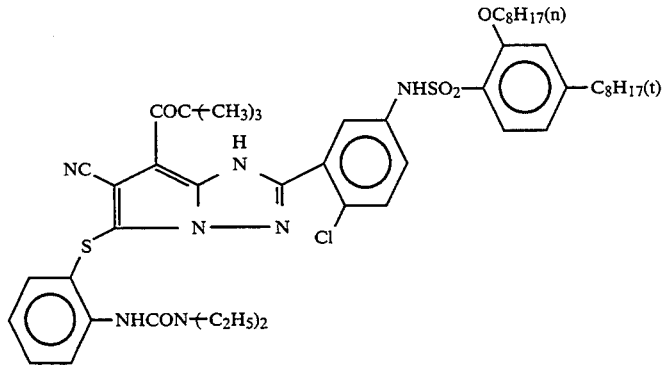

-continued
(C-19)
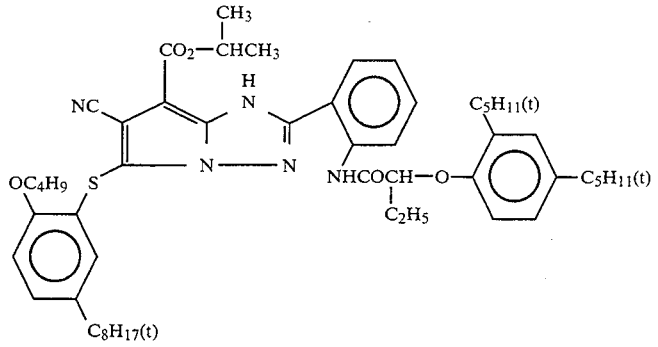
(C-20)
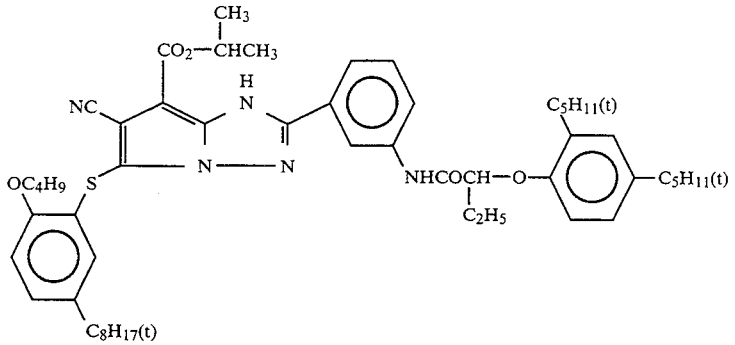
(C-21)
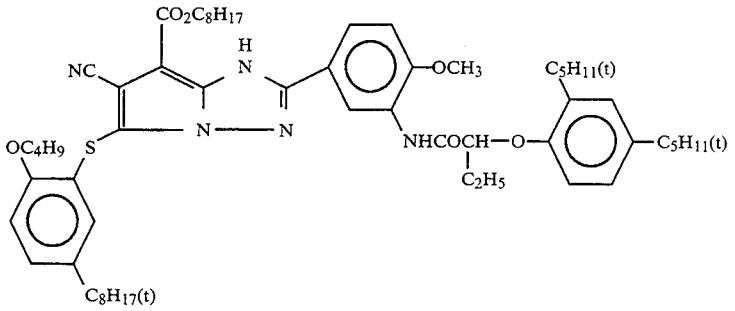
(C-22)
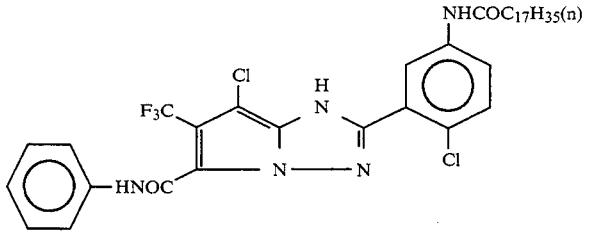
(C-23)
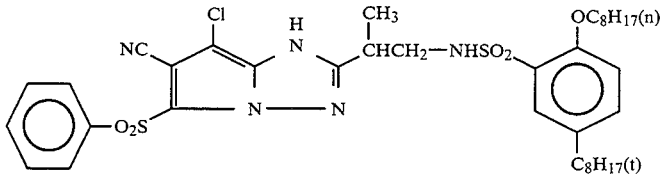
(C-24)
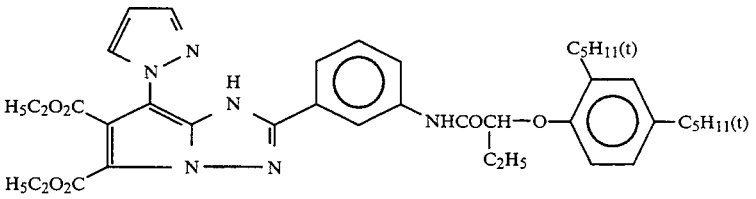

-continued
(C-25)
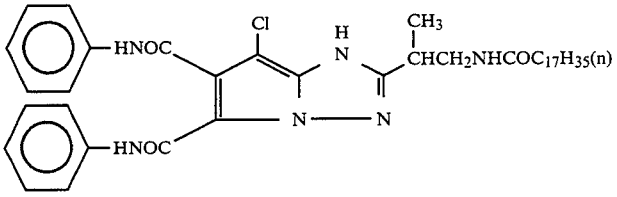
(C-26)
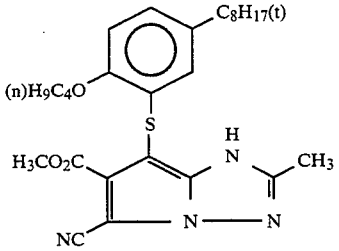
(C-27)
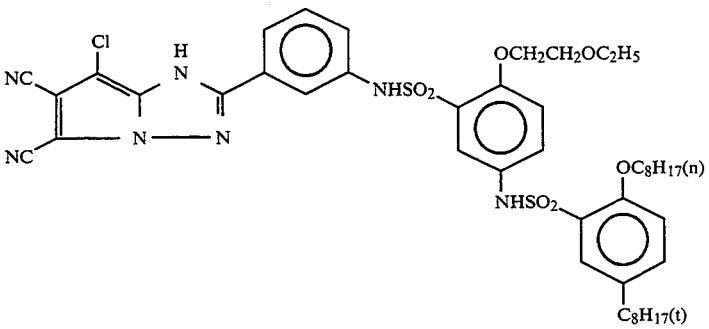
(C-28)
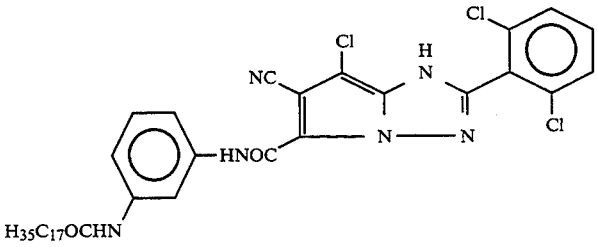
(C-29)
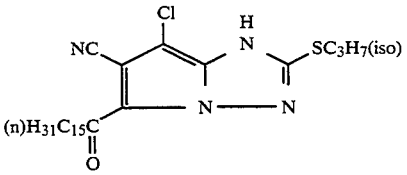
(C-30)
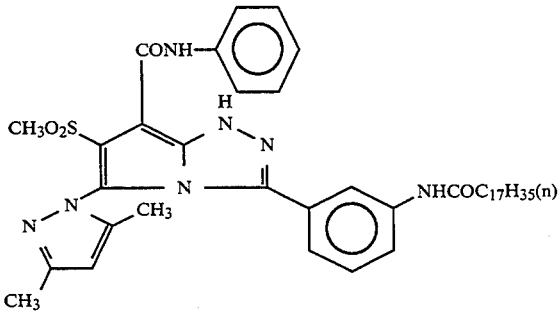

-continued
(C-31)
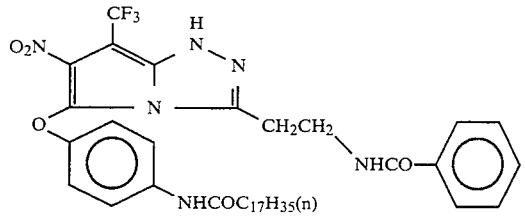
(C-32)
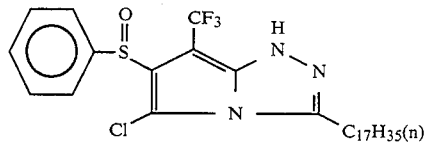
(C-33)
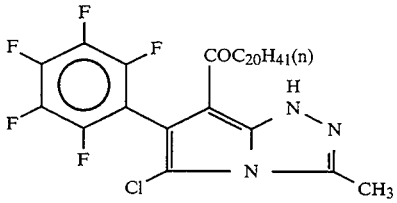
(C-34)
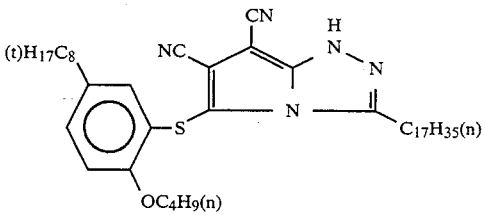
(C-35)
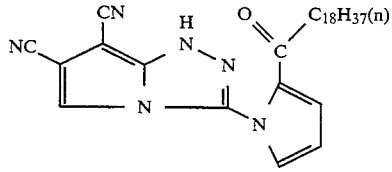
(C-36)
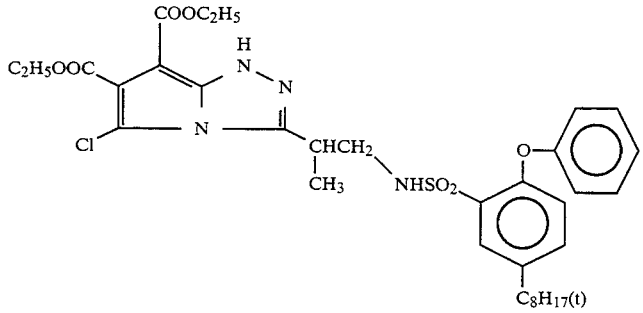
(C-37)
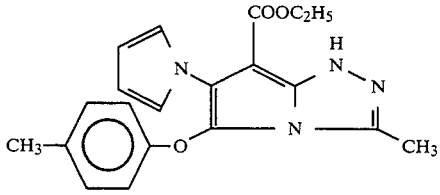

-continued
(C-38)
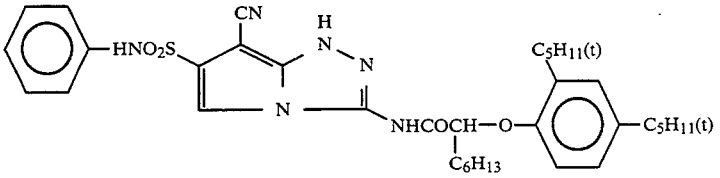
(C-39)
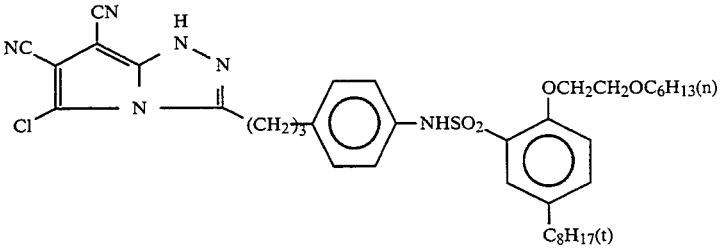
(C-40)
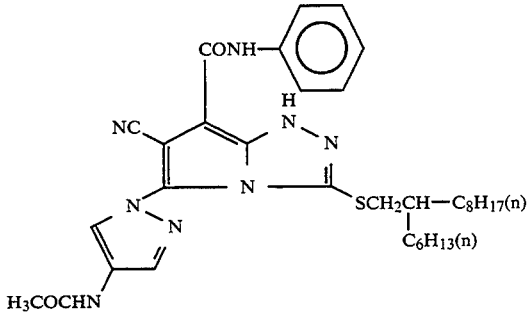
(C-41)
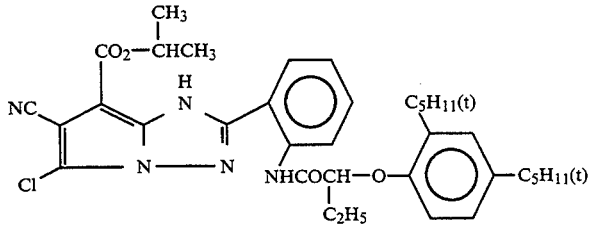
(C-42)
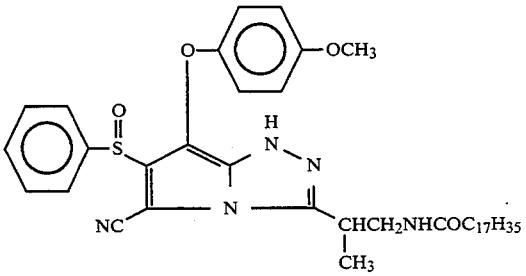
(C-43)
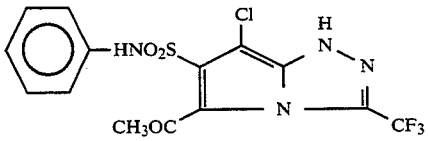
(C-44)
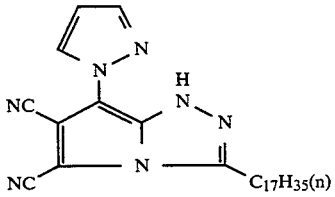

-continued
(C-45)
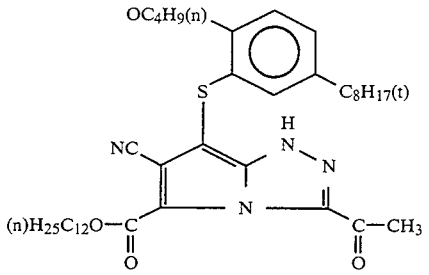
(C-46)
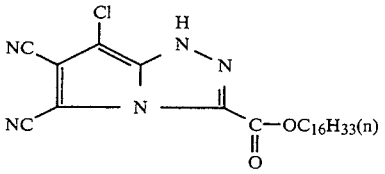
(C-47)
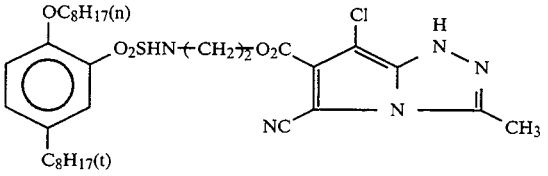
(C-48)
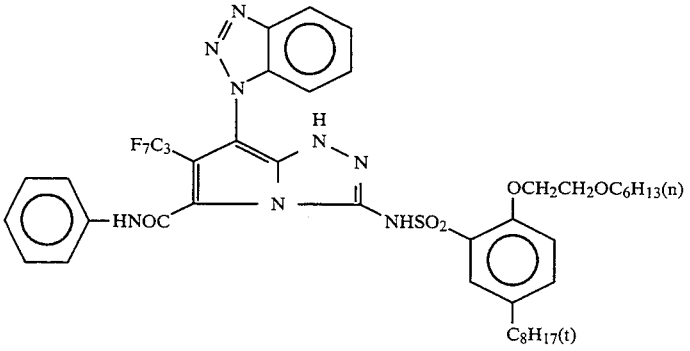
(C-49)
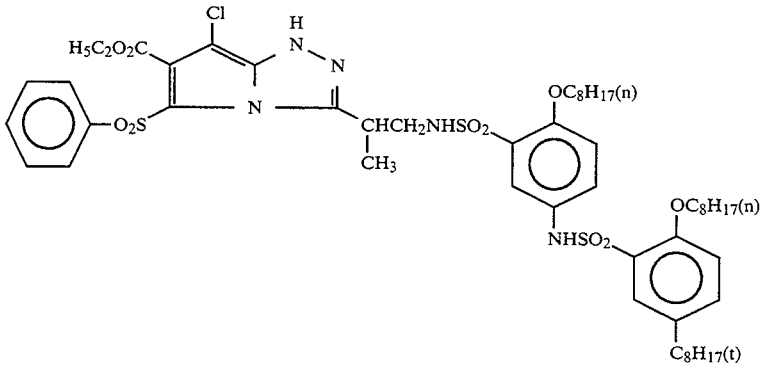

-continued
(C-50)
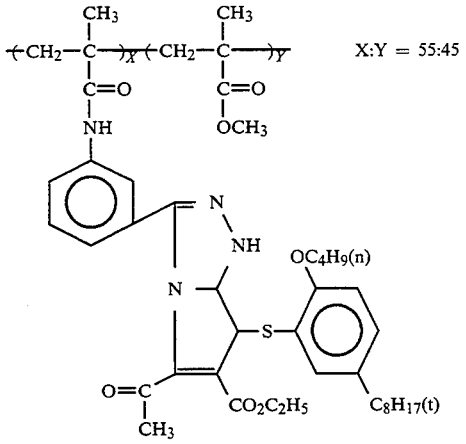
(C-51)
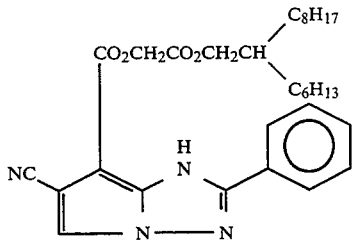
(C-52)
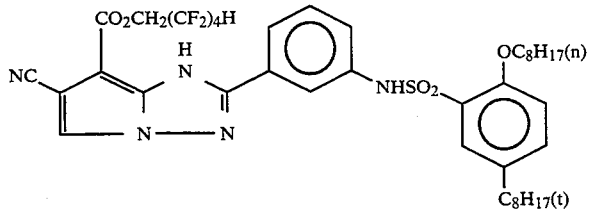
(C-53)
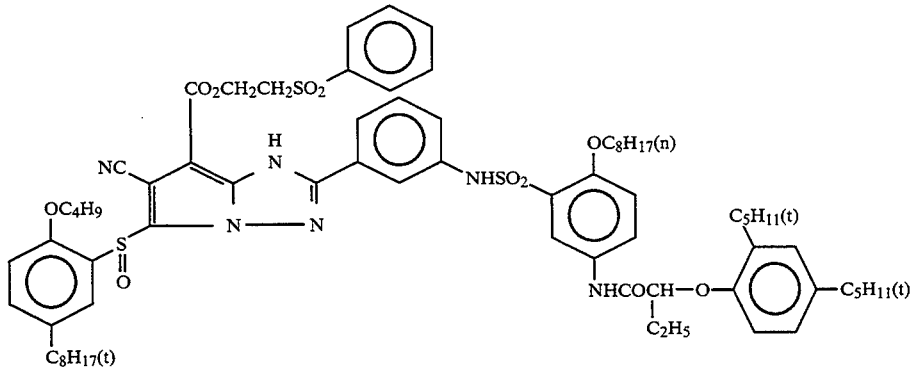
(C-54)
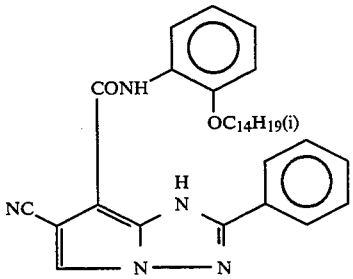

-continued
(C-55)
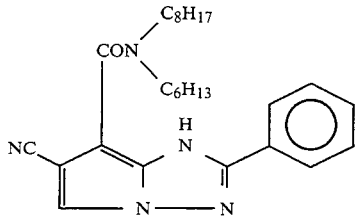
(C-56)
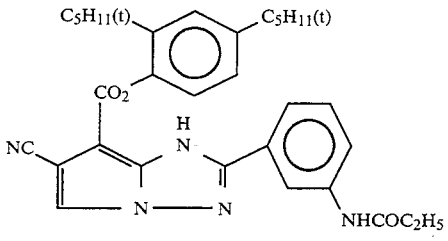
(C-57)
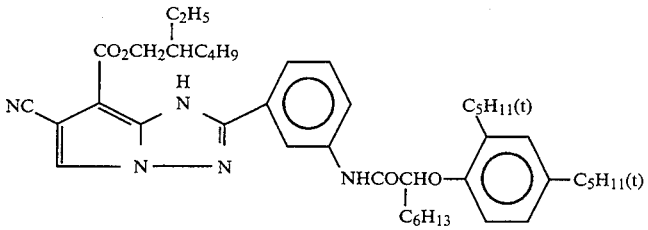
A method for the synthesis of the cyan coupler of the present invention is described in the following synthesis examples. Unless otherwise indicated herein, all parts, percents, ratios and the like are by weight.
SYNTHESIS EXAMPLE 1
(Synthesis of Compound C-1)
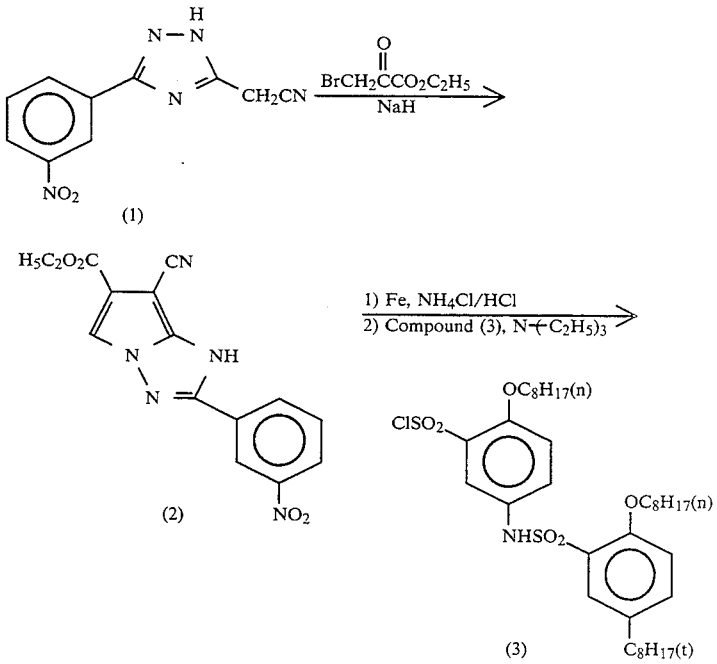

-continued

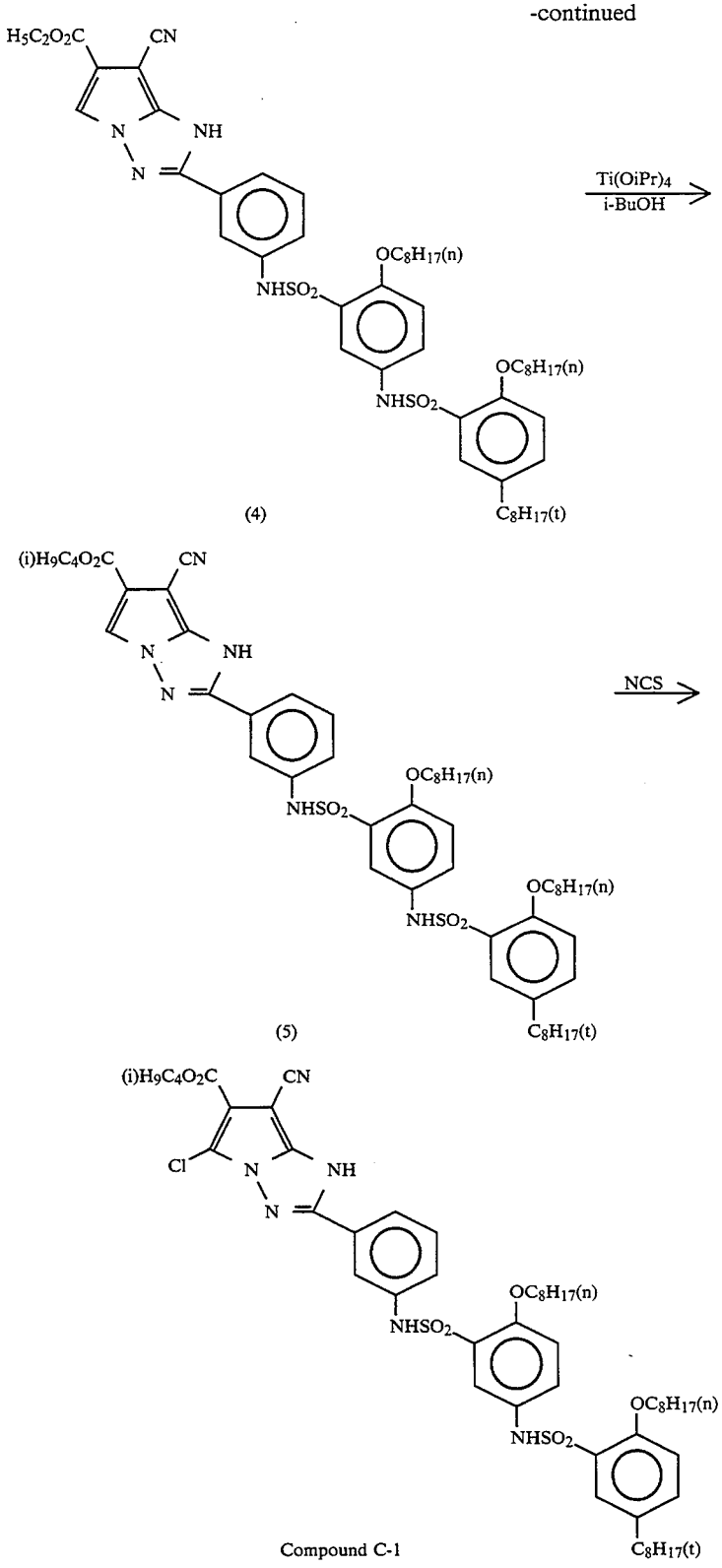

Compound C-1

20.0 g (87.3 mmol) of 3-m-nitrophenyl-5-methylcyano-1,2,4-triazole (1) was dissolved in 150 ml of dimethylacetamide. To the solution was gradually added 7.3 g (183 mmol) of a 60% mineral oil solution of NaH. The mixture was heated to a temperature of 80° C. To the material was gradually added dropwise a solution of 13.1 ml (105 mmol) of ethyl bromopyruvate in 50 ml of dimethylacetamide. After the dropwise addition, the material was stirred at a temperature of 80° C. for 30 minutes. The material was then cooled to room temperature (about 20°-30° C.). To the reaction solution was added a 1N hydrochloric acid to make it acidic. The material was then extracted with ethyl acetate. The material was then dried with sodium sulfate. The solvent was then distilled off under reduced pressure. The residue was then purified through silica gel chromatography to obtain 10.79 g (38%) of Compound (2).

9.26 g (166 mmol) of reduced iron and 0.89 g (16.6 mmol) of ammonium chloride were suspended in 300 ml of isopropanol. To the suspension were added 30 ml of water and 2 ml of concentrated hydrochloric acid. The material was then heated at reflux for 30 minutes with 10.79 g (33.2 mmol) of Compound (2) being gradually added thereto. The material was further heated at reflux for 4 hours. The material was then filtered through diatomaceous earth ("Celite", produced by Johns Manville Sales Corp.). The solvent of the filtrate was distilled off under reduced pressure. The residue was dissolved in a mixture of 40 ml of dimethyacetamide and 60 ml of ethyl acetate. To the solution was added 25.6 g (36.5 mmol) of Compound (3). To the material was then added 23.1 ml (166 mol) of triethylamine. The material was heated at a temperature of 70° C. for 5 hours. The reaction solution was then cooled to room temperature. The material was then extracted with ethyl acetate. The extract was washed with water, and then dried with sodium sulfate. The solvent was then distilled off under reduced pressure. The residue was then purified through silica gel chromatography to obtain 16.5 g (yield: 52%) of Compound (4).

7.0 g (7.30 mmol) of Compound (4) was dissolved in 14 ml of isobutanol. To the solution was added 0.43 ml (1.46 mmol) of tetraisopropyl orthotitanate. The material was then heated at reflux for 6 hours. The reaction solution was then cooled to room temperature. Water was then added to the material. The material was then extracted with ethyl acetate. The extract was dried with sodium sulfate. The solvent was then distilled off under reduced pressure. The residue was then purified through silica gel chromatography to obtain 5.0 g (yield: 69%) of Compound (5).

5.0 g (5.04 mmol) of Compound (5) was dissolved in 50 ml of tetrahydrofuran. To the solution was added dropwise 0.40 ml (5.04 mmol) of $SO_2Cl_2$ under cooling with water. After the dropwise addition, the material was further stirred under cooling with water for 4 hours. To the reaction solution was added water. The material was extracted with ethyl acetate. The extract was dried with sodium sulfate. The solvent was then distilled off under reduced pressure. The residue was then purified through silca gel chromatography to obtain 3.9 g (yield: 76%) of Compound C-1.

SYNTHESIS EXAMPLE 2

(Synthesis of Compound C-39)

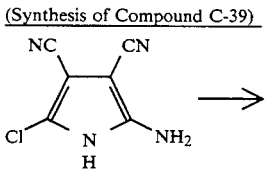

(6)

-continued

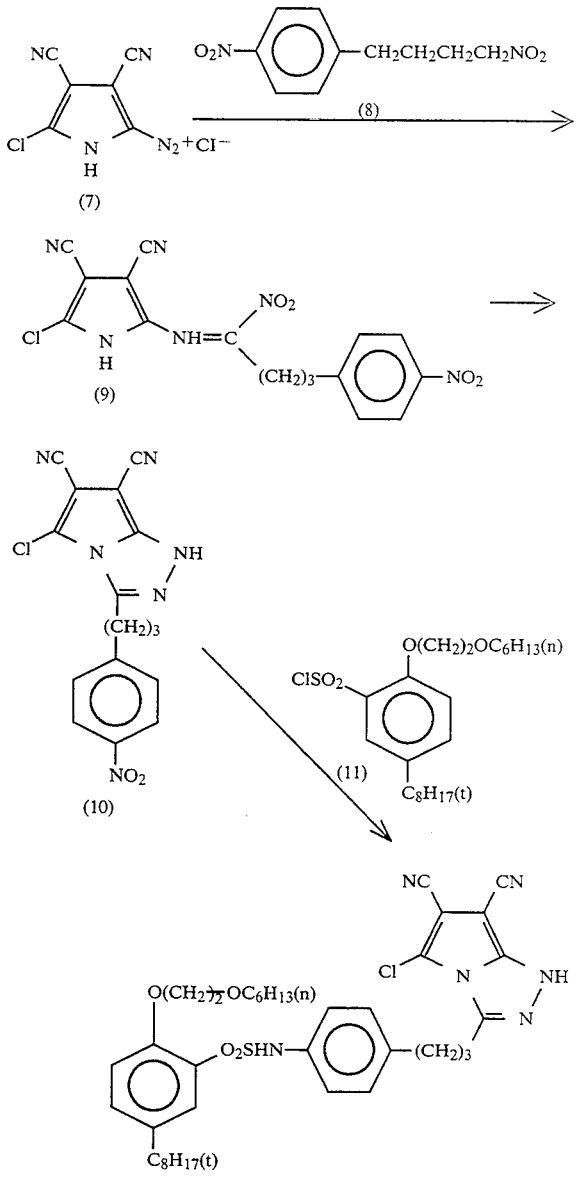

Compound C-39

To 6.78 g (40.7 mmol) of 2-amino-5-chloro-3,4-dicyanopyrrole (6) was added 38 ml of a 36% hydrochloric acid. To the mixture was gradually added dropwise a solution of 2.95 g (42.7 mmol) of sodium sulfite in 5.9 ml of water with stirring while cooling with ice. The mixture was further stirred for 1.5 hours to produce Compound (7). To a solution obtained by adding 102 ml of 28% sodium methylate to a solution of 9.58 g (427 mmol) of ethanol with stirring while cooling with ice was gradually added dropwise the previously prepared Compound (7) solution while cooling with ice. The material was further Stirred for 1 hour. The reaction solution was then heated at reflux with stirring for 1.5 hours. Ethanol was then distilled from the reaction solution under reduced pressure. The residue was then dissolved in chloroform, washed with saturated sodium chloride, and then dried with sodium sulfate. Chloroform was then distilled off under reduced pressure. The residue was then purified through silica gel column chromatography to obtain 4.19 g (yield: 29% based on Compound (6)) of Compound (10).

The synthesis of Compound (6) was carried out by chlorinating 3,4-dicyanopyrrole, nitrating the material, and then reducing the material with iron. Compound (8) was synthesized in accordance with the method described in *Journal of the American Chemical Society*, 7.6, 3209 (1954 ), from Compound (a) synthesized from γ-lactone and benzene using a known method.

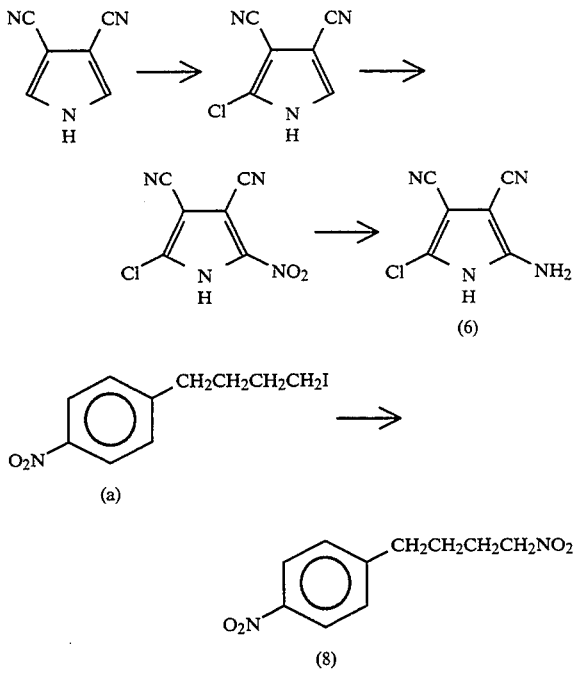

To 3.3 g (59.0 mmol) of powdered reduced iron were added 10 ml of water, 0.3 g (5.9 mmol) of ammonium chloride and 0.34 ml (5.9 mmol) of acetic acid. The mixture was then heated at reflux with stirring for 15 minutes. To the material was added 31 ml of isopropanol. The material was heated at reflux with stirring for 20 minutes. To the material was added dropwise a solution of 4.1 g (11.8 mmol) of Compound (10) in 14 ml of isopropanol. The material was heated at reflux with stirring for 2 hours. The reaction solution was then filtered with celite as a filtering aid. The residue was washed with ethyl acetate. The solution was then distilled off under reduced pressure.

The residue was dissolved in a mixture of 16 ml of ethyl acetate and 24 ml of dimethylacetamide. To the solution was addled 5.6 g (13.0 mmol) of Compound (11). To the material was added 8.2 ml (59.0 mmol) of triethylamine. The mixture was then stirred at room temperature for 4 hours. Water was added to the material. The material was then extracted with ethyl acetate. The extract was washed with saturated sodium chloride, and dried with sodium sulfate. The solvent was distilled off under reduced pressure. The residue was then purified through silica gel chromatorgraphy to obtain 6.46 g (yield: 76%) of Exemplary Compound C-39.

In the present invention, any known yellow couplers can be used as the yellow dye-forming coupler (hereinafter referred to as "yellow coupler"). Preferred of these known yellow couplers are those represented by the following general formula [Y]:

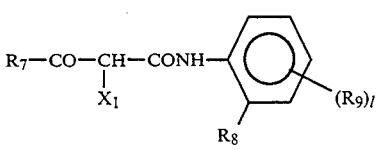

[Y]

wherein $R_7$ represents a tertiary alkyl group or an aryl group; $R_8$ represents a hydrogen atom, a halogen atom (F, Cl, Br, I, hereinafter the same), an alkoxy group, an aryloxy group, an alkyl group or a dialkylamino group; $R_9$ represents a group capable of replacing a hydrogen atom on the benzene ring; $X_1$ represents a hydrogen atom or a group capable of being released upon coupling with the oxidation product of an aromatic primary amine developing agent (releasable group); and l represents an integer of 0 to 4, with the proviso that when l is plural, the plurality of $(R_9)$'s may be the same or different.

Examples of $R_9$ include a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, an alkylsulfonyl group, an arylsulfonyl group, a ureide group, a sulfamoylamino group, an alkoxycarbonylamino group, a nitro group, a heterocyclic group, a cyano group, an acyl group, an acyloxy group, an alkylsulfonyloxy group, and an arylsulfonyloxy group. Examples of releasable groups include a heterocyclic group connected to the coupling active position via a nitrogen atom, an aryloxy group, an arylthio group, an acyloxy group, an alkylsulfonyloxy group, a heterocyclic oxy group, and a halogen atom. If $R_9$ is a tertiary alkyl group, it may contain a cyclic structure such as cyclopropyl, cyclobutyl, cyclopentyl and cyclohexyl.

In the general formula [Y], $R_7$ is preferably a t-butyl group, a 1-alkylcyclopropyl .group or a 1-alkylcyclopentyl group, $R_8$ is preferably a halogen atom, an alkyl group, an alkoxy group or a phenoxy group, $R_9$ is preferably a halogen atom, an alkoxy group, an alkoxycarbonyl group, a carbonamide group, a sulfonamide group, a carbamoyl group or a sulfonamide group, $X_1$ is preferably an aryloxy group or a 5- to 7-membered heterocyclic group which may further contain N, S, O, and P, connected to the coupling active position via a nitrogen atom, and l is preferably an integer of 0 to 2.

In the general formula [Y], if $R_7$ is a 1-alkylcyclopropyl group or a 1-alkylcyclopentyl group, the alkyl group is preferably a $C_{1-18}$ alkyl group, more preferably, a $C_{1-4}$ straight-chain alkyl group, most preferably an ethyl group.

The coupler represented by the general formula [Y] may be a copolymer containing a dimer or higher polymer, a homo polymer or noncoloring polymer unit connected to each other via a divalent or higher group at the substituent $R_7$, $X_1$ or the group represented by the general formula:

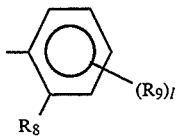

Specific examples of the couplers represented by the general formula [Y] are given below:
(1)
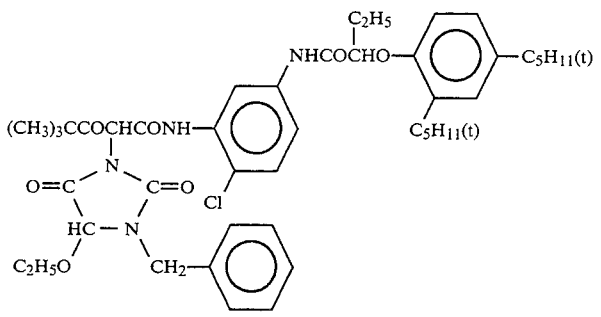
(2)
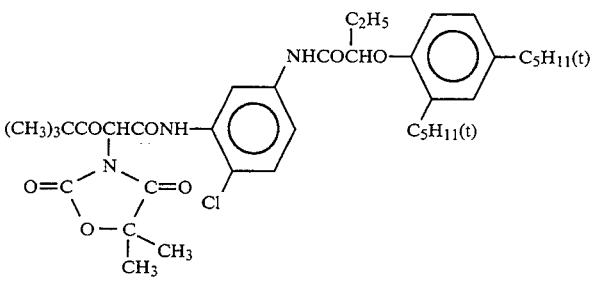
(3)
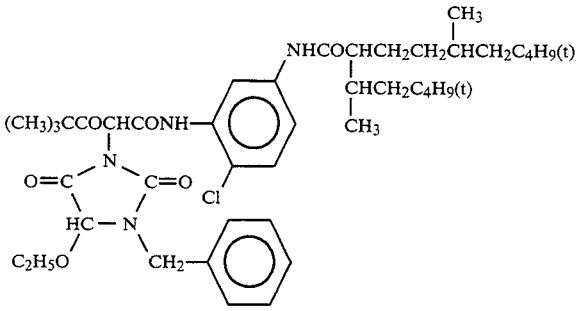
(4)
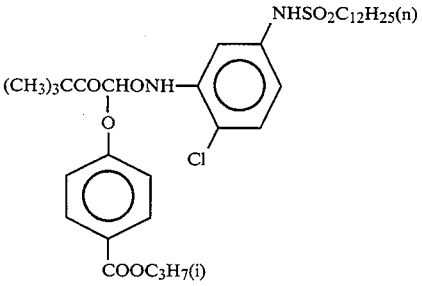
(5)
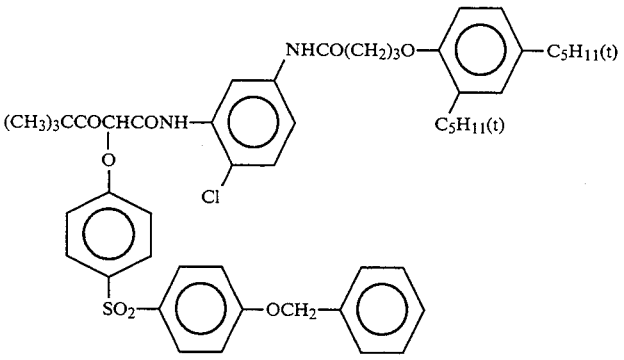

-continued
(6)
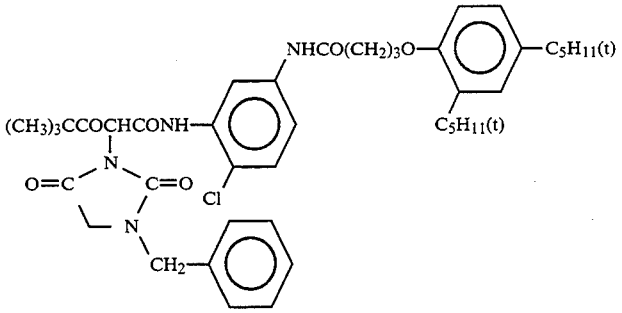
(7)
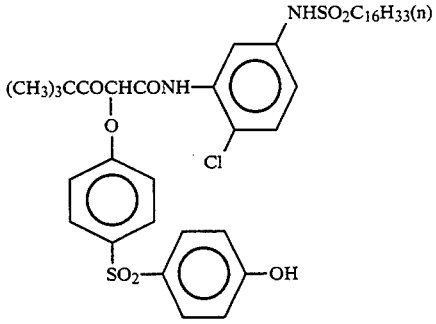
(8)
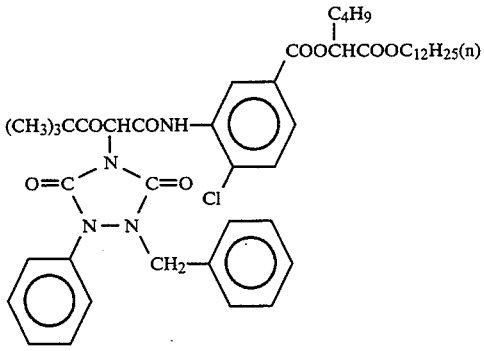
(9)
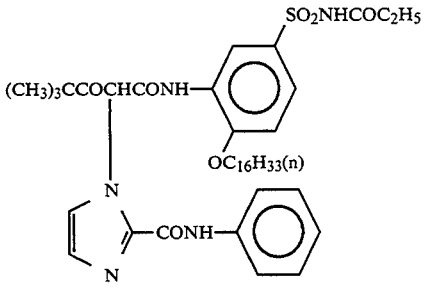
(10)
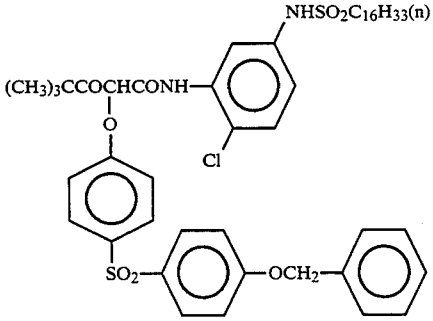

-continued
(11)
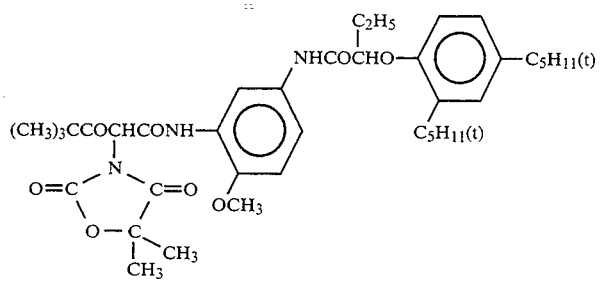
(12)
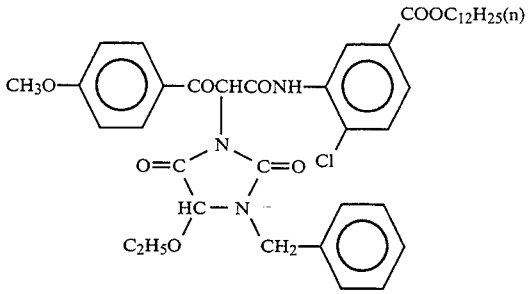
(13)
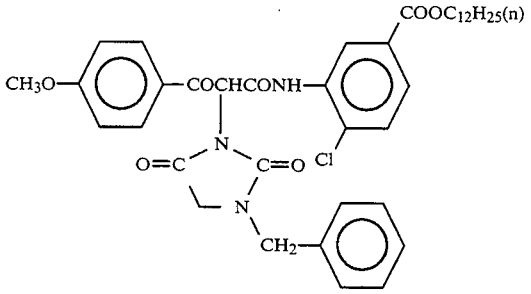
(14)
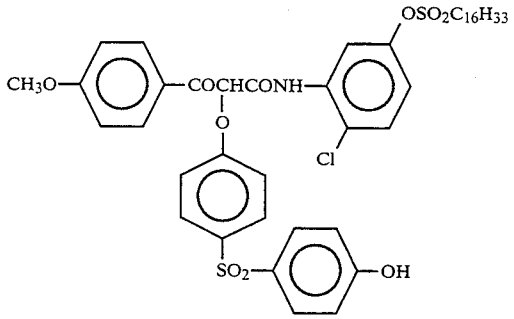
(15)
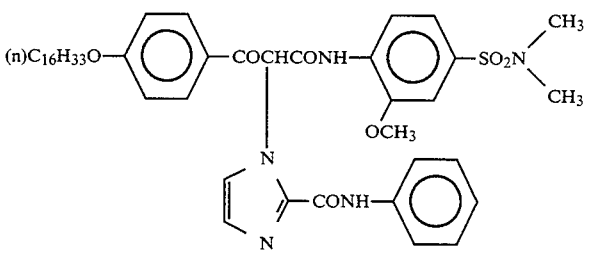

-continued
(16)
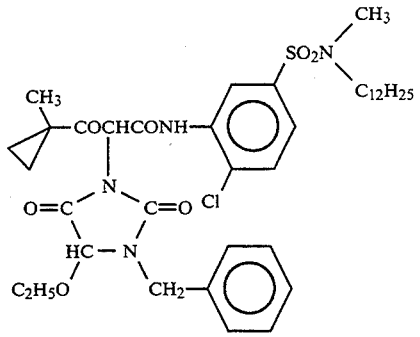
(17)
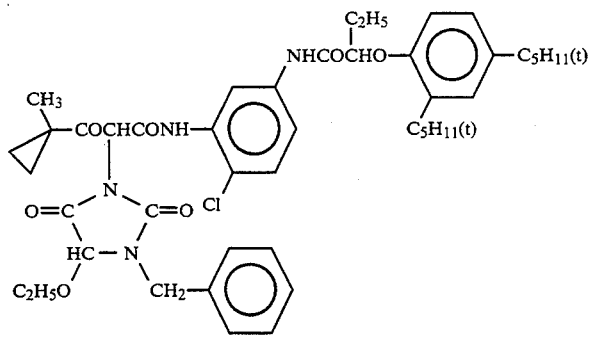
(18)
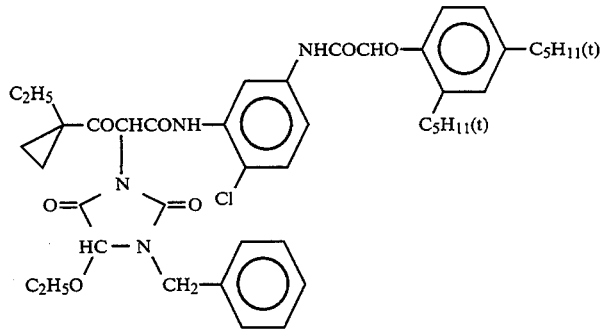
(19)
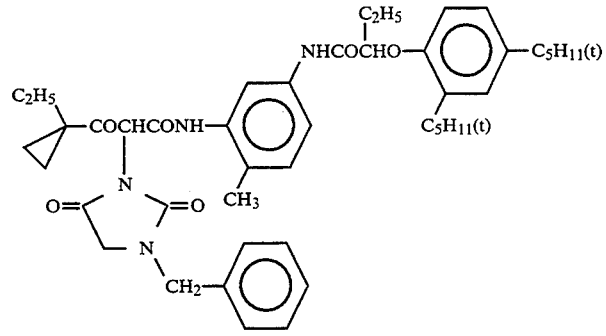

-continued (20)

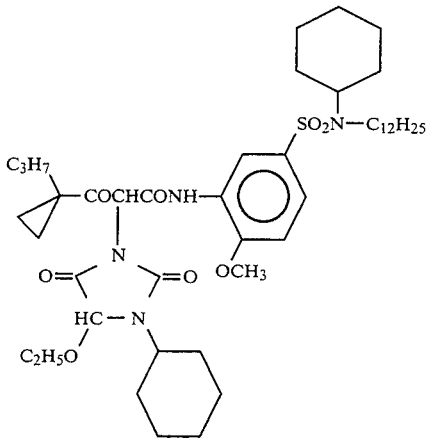

(21)

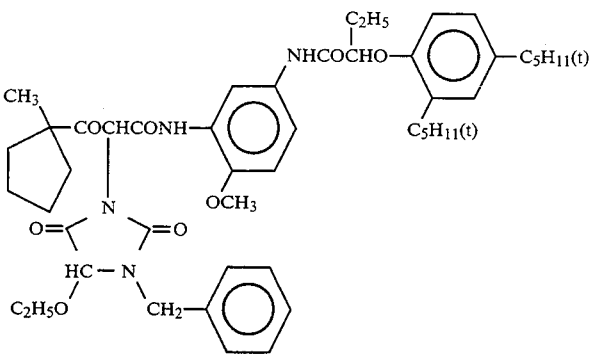

Examples of compounds other than the above described yellow couplers which can be used in the present invention and/or the method of synthesis thereof are described in U.S. Pat. Nos. 3,227,554, 3,408,194, 3,894,875, 3,933,501, 3,973,968, 4,022,620, 4,057,432, 4,115,121, 4,20,3,768, 4,248,961, 4,266,019, 4,314,023, 4,327,175, 4,401,752, 4,404,274, 4,420,556, 4,711,837, and 4,729,944, European Patents 30,747A, 284,081A, 296,793A, and 313,308A, West German Patent 3,107,173C, and JP-A-58-42044, JP-A-59-174839, JP-A-62-276547, and JP-A-63-123047.

Paraphenylenediamine compounds, particularly N,N-dialkyl-substituted paraphenylenediamine compounds have been frequently proposed as color developing agent to be used in the color developer. For example, with reference to the modification of the alkyl group which is substituted in the N-position, an N-hydroxyalkyl group is described in U.S. Pat. No. 2,108,243, British Patent 807,899, and European Patent 410,450A2, an N-sulfonamidoalkyl group is described in U.S. Pat. Nos. 2,193,015, 2,552,240, and 2,566,271, an N-sulfamoyl group is described in U.S. Pat. No. 2,193,015, an N-acylaminoalkyl group is described in U.S. Pat. Nos. 2,552,242, and 2,592,363, an N-alkoxyalkyl group is described in U.S. Pat. No. 2,374,337, an N-alkoxyalkyl group is described in U.S. Pat. No. 2,603,656, JP-A-47-11534, and JP-A-47-11535, and JP-B-54-16860, JP-B-58-14670, and JP-B-58-23618 (the term "JP-B" as used herein means an "examined Japanese patent publication"), an N-sulfoalkyl group is described in British Patent 811,679, and an N-aralkyl group is described in U.S. Pat. No. 2,716,132.

Further, with reference to the modification of substituent on the benzene nucleus, a nucleated alkoxy group is described in U.S. Pat. Nos. 2,304,953, 2,548,574, 2,552,240, and 2,592,364, a nucleated acylaminosulfonamide group is described in U.S. Pat. Nos. 2,350,109, and 2,449,919, a nucleated acylaminoalkyl sulfonamidoalkyl group is described in U.S. Pat. Nos. 2,552,241, 2,556,271, and 2,592,364, a nucleated amino group is described in U.S. Pat. Nos. 2,570,116, 2,575,027, and 2,652,331, and a nucleated thiosulfonic group is described in British Patent 872,683.

Moreover, with reference to the use of analogous paraphenylenediamine compounds as color developing agents, tetrahydroquinoline and dihydroindole compounds are described in U.S. Pat. Nos. 2,196,739, and 2,566,259, N-(p-aminophenyl)hexamethyleneimine compounds are described in U.S. Pat. No. 2,612,500, and 9-aminojulolidine compounds are described in U.S. Pat. No. 2,707,681.

The color developing agent to be used in the present invention is represented by the following general formula (III):

(III)

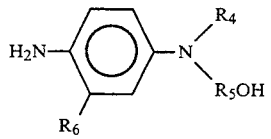

wherein $R_4$ represents a $C_{1-6}$ straight-chain or branched alkyl group or a $C_{3-6}$ straight-chain or branched hydroxyalkyl group; $R_5$ represents a $C_{3-6}$ straight-chain or branched alkylene group or a $C_{3-6}$ straight-chain or branched hydroxyalkylene group; and $R_6$ represents a hydrogen atom, a $C_{1-4}$ straight-chain or branched alkyl group or a $C_{1-4}$ straight-chain or branched alkoxy group.

The general formula (III) compounds will be further described hereinafter.

In the general formula (III), $R_4$ represents a $C_{1-6}$ straight-chain or branched alkyl group or a $C_{3-6}$ straight-chain or branched hydroxyalkyl group. Specific examples of such a group include a methyl group, an ethyl group, a a n-propyl group, isopropyl group, a n-butyl group, a sec-butyl group, a n-hexyl group, a neopentyl group, a 3-hydroxypropyl group, a 4-hydroxybutyl group, a 5-hydroxypentyl group, a 6-hydroxyhexyl group, a 4-hydroxypentyl group, a 3-hydroxybutyl group, a 4-hydroxy-4-methylpentyl group, and a 5,6-dihydroxyhexyl group.

$R_5$ represents a $C_{3-6}$ straight-chain or branched alkylene group or a $C_{3-6}$ straight-chain or branched hydroxyalkylene group. Specific examples of such a group include a trimethylene group, a tetramethylene group, a pentamethylene group, a hexamethylene group, a 1-methylethylene group, a 2-methylethylene group, a 1-methyltrimethylene group, a 2-methyltrimethylene group, a 3-methyltrimethylene group, a 3-methylpentamethylene group, a 2-methylpentamethylene group, a 2-ethyltrimethylene group, and a 3-hydroxypentamethylene group.

In the general formula (III), if $R_4$ is a straight-chain or branched alkyl group, it is preferably a $C_{1-4}$ alkyl group, particularly a methyl group, an ethyl group or an n-propyl group, most preferably an ethyl group. If $R_4$ is a $C_{1-4}$ straight-chain or branched alkyl group, $R_5$ is preferably a $C_{3-4}$ straight-chain or branched alkylene group, particularly a trimethylene group or a tetramethylene group, most preferably a tetramethylene group. On the other hand, in the general formula (III), if $R_4$ is a $C_{3-6}$ straight-chain or branched hydroxyalkyl group, $R_5$ preferably has 4 to 6 carbon atoms, more preferably 5 to 6 carbon atoms.

In the general formula (III), $R_4$ is preferably a $C_{1-4}$ straight-chain or branched alkyl group.

$R_6$ represents a hydrogen atom, a $C_{1-4}$ straight-chain or branched alkyl group or a $C_{1-4}$ straight-chain or branched alkoxy group. Specific examples of $R_6$ include a hydrogen atom, a methyl group, an ethyl group, a n-propyl group, a isopropyl group, a sec-butyl group, a methoxy group, an ethoxy group, and an isopropoxy group. $R^5$ is preferably an alkyl group, particularly a methyl group or an ethyl group, most preferably, a methyl group.

The compound represented by the general formula (III) is very unstable when it is stored in the form of the free amine. Therefore, the compound represented by the general formula (III) is preferably prepared and stored in the form of the inorganic or organic salt, and then it assumes the form of a free amine only when incorporated in the processing solution. Examples of inorganic or organic acids to be used for the formation of salts of the compound represented by the general formula (III) include hydrochloric acid, sulfuric acid, phosphoric acid, p-toluenesulfonic acid, methanesulfonic acid, and naphthalene-1,5-disulfonic acid. Preferred acids are sulfuric acid and p-toluenesulfonic acid, particularly sulfuric acid. For example, Compound D-12 as shown below is obtained in the form of sulfate with a melting point of 112° to 114° C. (recrystallized from ethanol).

Specific examples of typical developing agents to be used in the present invention are given below, but the present invention should not be construed as being limited thereto.

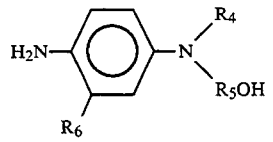

(III)

| Compound No. | $R_4$ | $R_5$ | $R_6$ |
|---|---|---|---|
| D-1 | $-CH_3$ | $-(CH_2)_3-$ | $-CH_3$ |
| D-2 | $-C_2H_5$ | $-(CH_2)_3-$ | $-CH_3$ |
| D-3 | $-C_2H_5$ | $-CH_2CH(CH_3)-$ | $-CH_3$ |
| D-4 | $-C_2H_5$ | $-CH(CH_3)-CH_2-$ | $-CH_3$ |
| D-5 | $-CH_3$ | $-(CH_2)_3-$ | $-C_2H_5$ |
| D-6 | $-C_2H_5$ | $-(CH_2)_3-$ | $-C_2H_5$ |
| D-7 | $-C_3H_7(n)$ | $-(CH_2)_3-$ | $-CH_3$ |
| D-8 | $-CH_3$ | $-(CH_2)_3-$ | $-C_3H_7(n)$ |
| D-9 | $-CH_3$ | $-(CH_2)_3-$ | $-C_4H_9(n)$ |
| D-10 | $-C_4H_9(n)$ | $-(CH_2)_3-$ | $-CH_3$ |
| D-11 | $-C_3H_7(n)$ | $-(CH_2)_4-$ | $-CH_3$ |
| D-12 | $-C_2H_5$ | $-(CH_2)_4-$ | $-CH_3$ |
| D-13 | $-CH_3$ | $-CH_2CH(CH_3)CH_2-$ | $-C_2H_5$ |
| D-14 | $-C_2H_5$ | $-CH_2CH_2CH(CH_3)-$ | $-C_2H_5$ |

-continued

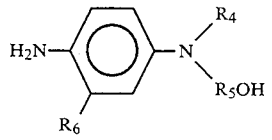

(III)

| Compound No. | $R_4$ | $R_5$ | $R_6$ |
|---|---|---|---|
| D-15 | $-C_2H_5$ | $-CH_2CH(CH_3)CH_2-$ | $-CH_3$ |
| D-16 | $-C_2H_5$ | $-CH_2CH_2CH(CH_3)-$ | $-CH_3$ |
| D-17 | $-C_2H_5$ | $-(CH_2)_5-$ | $-CH_3$ |
| D-18 | $-C_2H_5$ | $-(CH_2)_6-$ | $-CH_3$ |
| D-19 | $-(CH_2)_3OH$ | $-(CH_2)_3-$ | $-C_2H_5$ |
| D-20 | $-(CH_2)_5OH$ | $-(CH_2)_5-$ | $-CH_3$ |
| D-21 | $-(CH_2)_5OH$ | $-(CH_2)_6-$ | $-CH_3$ |
| D-22 | $-(CH_2)_5OH$ | $-(CH_2)_5-$ | $-C_2H_5$ |
| D-23 | $-(CH_2)_4OH$ | $-(CH_2)_5-$ | $-C_3H_7(i)$ |
| D-24 | $-(CH_2)_5OH$ | $-(CH_2)_3-CH(CH_3)-$ | $-CH_3$ |
| D-25 | $-C_3H_7(n)$ | $-(CH_2)_3-CH(CH_3)CH_2-$ | $-C_2H_5$ |
| D-26 | $-CH_2CH_2CH(OH)CH_2CH_3$ | $-(CH_2)_5-$ | $-CH_3$ |
| D-27 | $-CH_2CH(OH)C_2H_5$ | $-(CH_2)_4-$ | $-C_2H_5$ |
| D-28 | $-(CH_2)_4OH$ | $-(CH_2)_4-$ | $-C_4H_9(t)$ |
| D-29 | $-C_2H_5$ | $-(CH_2)_3-$ | H |
| D-30 | $-C_2H_5$ | $-(CH_2)_4-$ | $-OCH_3$ |
| D-31 | $-(CH_2)_5OH$ | $-(CH_2)_5-$ | $-OC_2H_5$ |
| D-32 | $-CH_2CH_2CH(OH)C_2H_5$ | $-(CH_2)_5-$ | H |
| D-33 | $-C_3H_7(n)$ | $-(CH_2)_4-$ | H |
| D-34 | $-(CH_2)_4OH$ | $-(CH_2)_4-$ | $-OC_3H_7(i)$ |
| D-35 | $-(CH_2)_5OH$ | $-(CH_2)_6-$ | H |
| D-36 | $-CH_3$ | $-(CH_2)_3-$ | $-OC_4H_9(t)$ |

Particularly preferred of these compounds represented by the general formula (III) are Compounds D-2, D-4, D-12, D-13, and D-16.

Of the color photographic light-sensitive materials to which the present invention is applicable, the color photographic paper may comprise at least one blue-sensitive silver halide emulsion layer, one green-sensitive silver halide emulsion layer and one red-sensitive silver halide emulsion layer coated on a support. In ordinary color photographic papers, these color-sensitive silver halide emulsion layers are normally coated on a support in this order. However, different layer orders may be used.

Image formation systems comprising a light-sensitive material and a processing system to be used in the present invention may be used for ordinary rapid processing of color prints. These image formation systems may be also used for intelligent color hard copy which requires faster processing.

In a preferred embodiment of an intelligent color hard copying system, a high density light source such as laser (e.g., a semiconductor laser) or a light-emitting diode is used for scanning exposure.

Most semiconductor lasers have a high light sensitivity in the infrared range. Light-sensitive materials for this purpose may comprise an infrared-sensitive silver halide emulsion layer instead of at least one of the above described emulsion layers. These light-sensitive emulsion layers may comprise silver halide emulsion layers sensitive to the respective wavelength ranges and so-called color couplers which form dyes complementary to light to which these silver halide emulsion layers are sensitive, i.e., a yellow coupler for blue light, a magenta coupler for green light, and a cyan coupler for red light, to effect subtractive color reproduction. However, another structure may also be used in which the color couplers form dyes not complementary to light to which the silver halide emulsion layers are sensitive.

There may be only two color couplers depending on the required image quality and photographic properties. In this case, there may be two silver halide emulsion layers corresponding to these color couplers. Although this structure does not provide a full color image, an image at a higher speed can be formed.

Silver bromochloride or silver chloride having a silver chloride content of 90 mol % or more can be used as the silver halide emulsion to be used in the present invention. The halogen composition of emulsion may be the same or different from grain to grain. If an emulsion having the same halogen composition between the grains is used, uniform grain properties can be easily achieved. The halogen composition distribution in the silver halide emulsion grain can be appropriately selected from the group consisting of the so-called uniform type structure in which the halogen composition is the same throughout the grain, a so-called laminated structure in which the halogen composition differs from the core to the shell [single or plural], and a structure in which nonlayer portions having different halogen compositions are localized inside or on the grains (portions having different halogen compositions are fused to the edge, corner or surface of the grains). In order to obtain a high sensitivity, the latter two structures are preferred to a uniform structure from the standpoint of pressure resistance. If the silver halide grains have such a structure, the border of the portions having different compositions may be definite or indefinite where a mixed crystal is formed by the difference in the halogen composition or a positively continuous structural change.

On the other hand, for the purpose of minimizing sensitivity red,action when the light-sensitive material is under pressure, the high silver chloride content emulsion to be used in the present invention having a silver chloride content of 90 mol % or more may advantageously comprise uniform structure grains having a small internal halogen composition distribution.

Further, for the purpose of reducing the replenishment rate of the developer, the silver chloride content of the silver halide emulsion can be further increased. In this case, an emulsion of almost pure silver chloride having a silver chloride content of 98 mol % to 100 mol % may be preferably used.

Silver halide emulsions which are preferably used in the present invention are described in detail in Japanese Patent Application No. Hei. 3-255889.

The light-sensitive material of the present invention may preferably comprise a dye decolorable by processing (particularly an oxonol dye) as disclosed in European Patent No. 0,337,490A2, pp. 27–76, in the hydrophilic colloidal layer in an amount such that the optical reflective density of the light-sensitive material at 680 nm is 0.70 or more, or titanium oxide surface treated with an alcohol having a valency of 2 to 4 (e.g., trimethylolethane) in the water-resistant resin layer in the support in an amount of 12% by weight or more (more preferably 14% by weight or more), for the purpose of improving image sharpness or the like.

The light-sensitive material of the present invention may preferably comprise a dye image preservability improving compound as disclosed in European Patent 0,277,589A2 in combination with couplers, particularly pyrazoloazolecouplers.

In particular, a compound (F) which chemical bonds to aromatic amine developing agent remaining after color development to produce a chemically inert and substantially colorless compound and/or a compound (G) which chemically bonds to the oxidation product of aromatic amine color developing agent remaining after color development to produce a chemically inert and substantially colorless compound may be preferably used alone or in combination to inhibit the formation of stain or other side effects caused by the formation of developed dyes by the reaction of a color developing agent or its oxidation product remaining in the film with a coupler on storage after processing.

The light-sensitive material of the present invention may advantageously comprise a mildew-proofing agent as disclosed in JP-A-63-271247 to prevent various mildew and bacteria from growing in the hydrophilic colloidal layer and deteriorating the image.

The support which can be used in the light-sensitive material of the present invention can be a white polyester support for display or a support comprising a white pigment-containing layer on the silver halide emulsion layer side. In order to further improve the image sharpness, an antihalation layer may be advantageously coated on the silver halide emulsion side or opposite side of the support. In order to enable display using reflected light or transmitted light, the transmission density of the support is preferably adjusted to a range of 0.35 to 0.8.

The light-sensitive material of the present invention may be exposed to visible light or infrared light. Exposure may be carried out with a low intensity exposure process or a high intensity-short time exposure process. In the latter case, a laser scanning exposure process with an exposure time of $10^{-4}$ seconds per pixel may be advantageously used.

The light-sensitive material which has been exposed to light may be subjected to color development. For the purpose of rapid processing, the color development is preferably followed by blix. In particular, if the above described high silver chloride content emulsion is used, the pH of the blix solution is preferably in the range of about 6.5 or less, more preferably about 6 or less for the purpose of accelerating the desilvering effect.

As silver halide emulsions and other materials (additives) to be incorporated in the light-sensitive material of the present invention, photographic layers of the light-sensitive material of the present invention, and processing methods and processing additives to be used in the processing of the light-sensitive material of the present invention can be those described in the following patents, particularly European Patent 0 355 660A2 (corresponding to Japanese Patent Application No. Hei. 1-107011):

| Photographic Element | JP-A-62-215272 | JP-A-2-33144 | EP 0 355 660 A2 |
|---|---|---|---|
| Silver Halide Emulsion | Line 6, upper right column, p. 10-line 5, lower left column, p.12/last line 4, lower right column, p. 12- | Line 16, upper right column, p. 28-line 11, lower right column, p. 29/line 2–5, p. 30 | Line 53, p. 45-line 3, p. 47/line 20–22, p. 47 |

-continued

| Photographic Element | JP-A-62-215272 | JP-A-2-33144 | EP 0 355 660 A2 |
|---|---|---|---|
| | line 17, upper left column, p. 13 | | |
| Silver Halide Solvent | Line 6–14, lower left column, p. 12/last line 3, upper right column-last line, lower left column, p. 18 | — | — |
| Chemical Sensitizer | Last line 3, lower left column-last line 5, lower right column, p. 12/line 1, lower right column, p. 18-last line 9, upper right column, p. 22 | Line 12-last line, lower right column, p. 29 | Line 4–9, p. 47 |
| Spectral Sensitizer (spectral sensitizing method) | Last line 8, upper right column, p. 22-last line, p. 38 | Line 1–13, upper left column, p. 30 | Line 10–15, p. 47 |
| Emulsion Stabilizer | Line 1, upper left column, p. 39-last line, upper right column, p. 72 | Line 14, upper left column-line. 1, upper right, p. 30 | Line 16–19, p. 47 |
| Development Accelerator | Line 1, lower left column, p. 72-line 3, upper right column, p. 91 | — | — |
| Color Coupler (cyan, magenta, yellow coupler) | Line 4, upper right column, p. 91-line 6, upper left column, p. 121 | Line 14, upper right column, p. 3-line 18, upper left column, p. 18/line 6, upper right column, p. 30-line 11,upper left column, p. 35 | Line 15–27, p. 4/line 30, p. 5-last line, p. 28/line 29–31, p. 45/line 23, p. 47-line 50, p. 63 |
| Color Intensifier | Line 7, upper left column, p. 121-line 1, upper right column, p. 125 | — | — |
| Ultraviolet Absorbent | Line 2, upper right column, p. 125-last line, lower left column, p. 127 | Line 14, lower right column, p. 37-line 11, upper left column, p. 38 | Line 22–31, p. 65 |
| Discoloration Inhibitor (image stabilizer) | Line 1, lower right column, p. 127-line 8, lower left column, p.137 | Line 12, upper right column, p. 36-line 19, upper lower column, p. 37 | Line 30, p. 4-line 23, p. 5/line 1, p. 29-line 25, p. 45/line 33–40, p. 45/line 2–21, p. 65 |
| High Boiling and/or Low Boiling organic Solvent | Line 9, lower left column, p. 137-last line, upper right column, p. 144 | Line 14, lower right column, p. 35-last line 4, upper left column, p. 36 | Line 1–51, p. 64 |
| Process for Dispersion of Photographic Additives | Line 1, lower left column, p. 144-line 7, upper right column, p. 146 | Line 10, lower right column, p. 27-last line, upper left column, p. 28/line 12, lower right column, p. 35-line 7, upper right column, p. 36 | Line 51, p. 63-line 56, p. 64 |
| Film Hardener | Line 8, upper right column, p. 146-line 4, lower left column, p. 155 | — | — |
| Developing Agent Precursor | Line 5, lower left column, p. 155-line 2, lower right column, p. 155 | — | — |
| Development Inhibitor-Releasing Compound | Line 3–9, lower right column, p. 155 | — | — |
| Support | Line 19, lower right column, p. 155-line 14, upper left column, p. 156 | Line 18, upper right column, p. 38-line 3, upper left column, p. 39 | Line 29, p. 66-line 13, p. 67 |
| Constitution of Light-Sensitive Layer | Line 15, upper left column, p. 156-line 14, lower right column, p. 156 | Line 1–15, upper right column, p. 28 | Line 41–52, p. 45 |
| Dye | Line 15, lower right column, p. 156-last line, lower right column, p. 184 | Line 12, upper left column,-line 7, upper right column, p. 38 | Line 18-line 22, p. 66 |
| Color Stain inhibitor | Line 1, upper left column, p. 185-line 3, lower right column, p. 188 | Line 8–11, upper right column, p. 36 | Line 57, p. 64-line 1, p. 65 |
| Gradation Adjustor | Line 4–8, lower right column, p. 188 | — | — |
| Stain Inhibitor | Line 9, lower right column, p. 188-line 10, lower right column, p. 193 | Last line, upper left column-line 13, lower right column, p. 37 | Line 32, p. 65-line 17, p. 66 |

-continued

| Photographic Element | JP-A-62-215272 | JP-A-2-33144 | EP 0 355 660 A2 |
|---|---|---|---|
| Surface Active Agent | Line 1, lower left column, p. 201-last line, upper right column, p. 210 | Line 1, upper right column, p. 18-last line, lower right column, p.24/ last line 10, lower left column-line 9, lower right column, p. 27 | — |
| Fluorine-Containing Compound (antistatic agent, coating aid, lubricant, adhesion inhibitor) | Line 1, lower left column, p. 210-line 5, lower left column, p. 222 | Line 1, upper left column, p. 25-line 9, lower right column, p. 27 | — |
| Binder (hydrophilic colloid) | Line 6, lower left column, p. 222-last line, upper left column, p. 225 | Line 8–18, upper right column, p. 38 | Line 23–28, p. 66 |
| Thickening Agent | Line 1, upper right column, p. 225-line 2, upper right column, p. 227 | — | — |
| Antistatic Agent | Line 3, upper right column, p. 227-line 1, upper left column, p. 230 | — | — |
| Polymer Latex | Line 2, upper left column, p. 230-last line, p. 239 | — | — |
| Matting Agent | Line 1, upper left column, p. 240-last line, upper right column, p. 240 | — | — |
| Photographic Processing Method (processing step, additive, etc.) | Line 7, upper right column, p. 3-line 5, upper right column, p. 10 | Line 4, upper left column, p. 39-last line, upper left column, p. 42 | Line 14, p. 67-line 28, p. 69 |

(Note)
The references to JP-A-62-215272 include the written amendment thereto dated March 16, 1987 attached thereto.
Of the so-called short wave type yellow couplers as disclosed in JP-A-63-231451, JP-A-63-123047, JP-A-63-241547, JP-A-1-173499, JP-A-1-213648, and JP-A-1-250944 may also be advantageously used as yellow couplers.

3-Hydroxypyridine cyan couplers as disclosed in European Patent (EP) 0,333,185A2 (particularly those which have been rendered two-equivalent by incorporating a chlorine-releasable group in Coupler (42) exemplified as a specific example, Coupler (6), Coupler (9)) or cyclic active methylene cyan couplers as disclosed in JP-A-64-32260 (particularly Coupler Examples 3, 8, 34 exemplified as specific examples) in addition to diphenylimidazole cyan couplers as disclosed in JP-A-2-33144 can be advantageously used as cyan couplers.

The color photographic light-sensitive material of the present invention is preferably subjected to color development, blix, and rinse (or stabilization). Bleach and fixing may be effected separately rather than in the above described monobath blix process.

Known color developing agents may be used in the present invention. Typical examples of such known color developing agents include 4-amino-N-ethyl-N-(β-hydroxyethyl)-3-methylaniline, 4-amino-N-ethyl-N-(β-methanesulfonamidoethyl)-3-methylaniline, and 4-amino-N-(3-carbamoylpropyl-N-n-propyl-3-methylaniline. However, the present invention is not to be construed as being limited to these color developing agents.

These p-phenylenediamine derivatives may be used in the form of the salts thereof such as the sulfate, hydrochloride, sulfite, naphthalenedisulfonate and p-toluenesulfonate salts. The amount of the aromatic primary amine color developing agent to be used in the present invention is preferably in the range of about 0.002 mol to 0.2 mol, more preferably 0.005 mol to 0.1 mol per l of color developer (running solution).

A developer substantially free of benzyl alcohol may be advantageously used in the process of the present invention. The term "substantially free of benzyl alcohol" as used herein means "containing benzyl alcohol in an amount of preferably 2 ml/l or less, more preferably 0.5 ml or less, most preferably none."

More preferably, the developer to be used in the present invention is substantially free of sulfite ions. Sulfite ions serve as a preservative for developing agent. Sulfite ions also serve to dissolve silver halide and react with the oxidation product of the developing agent to reduce the efficiency of dye formation. This effect is presumed to be one of the causes of the fluctuation in the photographic properties with continuous processing. The term "substantially free of sulfite ions" as used herein means "containing sulfite ions in an amount of preferably 0.10 mol/l or less, most preferably none, per mol of developing agent." However, in the present invention, an extremely small amount of sulfite ions used to inhibit the oxidation of a processing kit comprising concentrated developing agent which is to be diluted before use is excluded.

The developer to be used in the present invention needs to be substantially free of sulfite ions. Further, the developer needs to be substantially free of hydroxylamine. This is probably because hydroxylamine not only serves as developer preservative but also exhibits silver development activity itself, greatly affecting the photographic properties when its concentration fluctuates. The term "substantially free of hydroxylamine" as used herein means "containing hydroxylamine in an amount of preferably $5.0\times10^{-3}$ mol/l or less, most preferably none."

More preferably, the developer to be used in the present invention comprises an organic preservative instead of the above mentioned hydroxylamine or sulfite ions.

An organic preservative is an organic compound which reduces the deterioration rate of the aromatic primary amine color developing agent when such is present in a color photographic light-sensitive material, i.e., an organic compound which inhibits the oxidation of the color developing agent by air or the like. In particular, hydroxylamine derivatives (exluding hydroxylamine, hereinafter the same), hydroxamic acids, hydrazines, hydrazides, phenols, α-hydroxyketones, α-aminoketones, saccharides, monoamines, diamines, polyamines, tertiary ammonium salts, nitroxy radicals, alcohols, oximes, diamide compounds, and condensed ring amines are effective organic preservatives. These compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, and JP-A-52-143020, U.S. Pat. Nos. 3,615,503, and 2,494,903, and JP-B-48-30496.

Other examples of preservatives which can be incorporated in the color developer as desired include various metals as described in JP-A-57-44148 and JP-A-57-53749, salicyclic acids as described in JP-A-59-180588, alkanolamines as described in JP-A-54-3532, polyethyleneimines as described in JP-A-56-94349, and aromatic polyhydroxy compounds as described in U.S. Pat. No. 3,746,544. In particular, alkanolamines such as triethanolamine, dialkylhydroxylamine such as diethylhydroxylamine, hydrazine derivatives or aromatic polyhydroxy compounds may be advantageously used.

Particularly preferred of these organic preservatives are hydroxylamine derivatives and hydrazine derivatives (e.g., hydrazines, hydrazides). These compounds are further described in JP-A-1-97953, JP-A-1-186939, JP-A-1-186940, and JP-A-1-187557.

The above mentioned hydroxylamine derivatives or hydrazine derivatives can be advantageously used in combination with amines to improve the stability of the color developer and hence the stability of the system during continuous processing.

Examples of the above mentioned amines include cyclic amines as described in JP-A-63-239447, amines as described in JP-A-63-128340, and amines as described in JP-A-1-186939 and JP-A-1-187557.

In the present invention, as hydroxylamine derivatives there are preferably used those represented by the following general formula (IV):

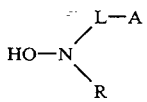

(IV)

wherein L represents an alkylene group which may be substituted; A represents a carboxyl group, a sulfo group, a phosphono group, a phosphino group, a hydroxyl group, an amino group which may be alkyl-substituted, an ammonio group which may be alkyl-substituted, a carbamoyl group which may be alkyl-substituted, a sulfamoyl group which may be alkyl-substituted or an alkylsulfonyl group which may be substituted; and R represents a hydrogen atom or an alkyl group which may be substituted.

Specific examples of hydroxylamine derivatives which can be used in the present invention are given below, but the present invention is not to be construed as being limited thereto.

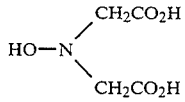

(IV-1)

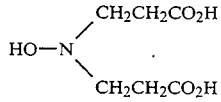

(IV-2)

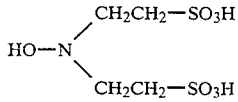

(IV-3)

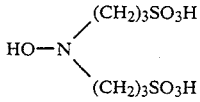

(IV-4)

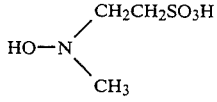

(IV-5)

Specific examples of sulfinic acids and salts thereof which can be used in the present invention are given below.

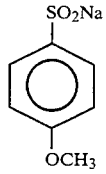

(S-1)

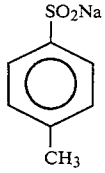

(S-2)

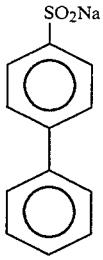

(S-3)

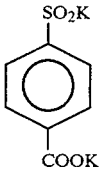

(S-4)

-continued

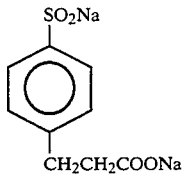

(S-5)

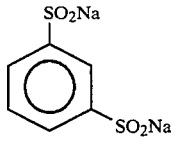

(S-6)

These compounds may be used alone or in admixture.

These sulfinic acids can be synthesized in accordance with the method described in JP-A-62-143048 or a similar method.

The amount of the sulfinic acid used in the present invention is in the range of 0.001 to 1.0 mol/l, preferably 0.002 to 0.2 mol/l.

In the present invention, the color developer preferably contains chloride ions in an amount of $3.5\times10^{-3}$ to $3.0\times10^{-1}$ mol/l, particularly $1\times10^{-2}$ to $2\times10^{-1}$ mol/l. If this value exceeds $3.0\times10^{-1}$ development is retarded, making it difficult to accomplish the objects of the present invention, i.e., rapid processing and high maximum density. On the contrary, if this value falls below $3.5\times10^{-3}$ mol/l, it is disadvantageous in the inhibition of fog.

In the present invention, the color developer preferably comprises bromine ions in an amount of $0.5\times10^{-5}$ mol/l to $1.0\times10^{-3}$ mol/l, more preferably $3.0\times10^{-5}$ mol/l to $5\times10^{-4}$ mol/l. If this value exceeds $1\times10^{-3}$ mol/l, development is retarded and maximum density and sensitivity are reduced. If it is less than $0.5\times10^{-5}$ mol/l, occurrence of fog cannot effectively be prevented.

Chloride ions and bromide ions may be directly added to the developer or may be eluted from the light-sensitive material into the developer during development.

Examples of chloride ion-supplying substances which can be directly added to the color developer include sodium chloride, potassium chloride, ammonium chloride, lithium chloride, nickel chloride, magnesium chloride, manganese chloride, calcium chloride, and cadmium chloride. Preferred of these substances are sodium chloride and potassium chloride.

Alternatively, chloride ions may be supplied from a fluorescent brightening agent incorporated in the developer.

Examples of bromide ion-supplying substances include sodium bromide, potassium bromide, ammonium bromide, lithium bromide, calcium bromide, magnesium bromide, manganese bromide, nickel bromide, cadmium bromide, serium bromide, and thallium bromide. Preferred of these substances are potassium bromide and sodium bromide.

If chloride or bromide ions are eluted from the light-sensitive material during development, they may be both supplied from an emulsion or other portions.

The color developer which is used in the present invention preferably has a pH of 9 to 12, more preferably 9.5 to 11.0. The color developer may further comprise compounds which are conventional in color developers.

In order to maintain the above specified pH range, various buffers are preferably used. Such buffers include carbonates, phosphates, borates, tetraborates, hydroxybenzoates, glycol salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. In particular, the carbonate, phosphate, tetraborate, and hydroxybenzoate are advantageous in that they have excellent buffering capacity at a high pH range as 9.0 or more and thus do not adversely affect the photographic properties (e.g., fog) even when added to the color developer. Thus, these buffers are particularly preferred.

Specific examples of suitable buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not to be construed as being limited to these compounds.

The amount of the buffer to be incorporated in the color developer and its replenisher is preferably in the range of 0.1 mol/l or more, particularly 0.1 to 0.4 mol/l.

The color developer may further comprise various chelating agents such as calcium or-magnesium suspending agents or to improve the stability thereof. Specific examples of such organic acid compounds include nitrilotriacetic acid, diethylenetriaminepentaacetic acid, ethylenediaminetetraacetic acid, N,N,N-trimethylenephosphonic acid, ethylenediamine-N,N,N',N'-tetramethylene phosphonic acid, transcyclohexanediaminetetraacetic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-l,l-diphosphonic acid, N,N'bis(2-hydroxybenzyl)ethylenediamine-N,N,-diacetic acid, and 1,2-hydroxybenzene-4,6-disulfonic acid.

Two or more such chelating agents can be used in combination as if desired.

The appropriate amount of such a chelating agent present in the color developer is that amount sufficient to block metallic ions in the color developer, e.g., 0.1 g to 10 g/l.

The color developer may optionally contain development accelerators.

Examples of suitable development accelerators which can be incorporated in the color developer include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554 , tertiary ammonium salts as disclosed in JP-A-50-137726, JP-A-56-156826 and JP-A-52-43429, and JP-B-44-30074, amine compounds as disclosed in U.S. Pat. Nos. 2,494,903, 3,128,182, 4,230,796, 3,253,919, 2,482,546, 2,596,926, and 3,582,346 and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, and 1-phenyl-3-pyrazolidones, imidazoles and ascorbic acids.

The color developer replenisher which can be used in the present invention can comprise fog inhibitors as desired. Examples of fog inhibitors which can be used include a halide of alkali metal such as sodium chloride, potassium bromide and potassium iodide or organic fog inhibitors. Typical examples of organic fog inhibitors include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolidine, and adenine.

The color developer used in the present invention may comprise a fluorescent brightening agent. Examples of fluorescent brightening agent are 4,4'-diamino-2,2'-disulfostilbene compounds. The amount of fluorescent brightening agents to be incorporated in the color developer is in the range of 0 to 5 g/l, preferably 0.1 to 4 g/l.

The color developer to be used in the present invention may include various surface active agents such as various known water-soluble polymers (e.g., polyvinyl alcohol, polyacrylic acid, polystyrenesulfonic acid, polyacrylamide, polyvinyl pyrrolidone, copolymers thereof), alkylsulfonic acid, arylsulfonic acid, aliphatic carboxylic acid and aromatic carboxylic acid as necessary.

The temperature at which the processing used in the present invention is effected with the color developer is in the range of 20° to 50° C., preferably 30° to 45° C. The time during which the present processing is effected with the color developer is in the range of 5 seconds to 240 seconds, preferably 10 seconds to 60 seconds. The replenishment rate of the color developer is preferably predetermined at a small value. Appropriate replenishment is in the range of 20 to 600 ml, preferably 120 ml or less, more preferably 60 ml from the standpoint of the accomplishment of the effects of the present invention.

The color development process used in the present invention exhibits relatively excellent properties as compared with combinations other than those of the present invention no matter what the liquid opening value {contact area with air ($cm^2$)/liquid volume ($cm^3$)} is. From the standpoint of stability of the color developer, the liquid opening value is preferably in the range of 0 to 0.1 $cm^{-1}$. In the running processing procedure, the liquid opening value is preferably in the range of 0.001 $cm^{-1}$ to 0.05 $cm^{-1}$, more preferably 0.002 to 0.03 $cm^{-1}$.

In order to reduce the opening value, a cover such as floating cover may be provided on the surface of the photographic processing solution in the processing bath. Alternatively, a movable cover as described in JP-A-62-241342 or a slit development process as described in JP-A-63-216050 may be used.

Desilvering processes which can be employed in the present invention are described hereinafter. The desilvering process may be used in the bleach-fixing step, the fixing-blix step, the bleach-blix step, the blix step, etc.

The bleaching solution, the blix solution and the fixing solution which can be employed in the present invention and is described hereinafter.

Any bleaching agent can be used as the bleaching agent to be used in the bleaching solution or blix solution. In particular, complexes of iron (III) with organic acids (e.g., aminopolycarboxylic acids such as ethylenediaminetetraacetic acid and diethylenetriaminepentaacetic acid, aminopolyphosphonic acid, phosphonocarboxylic acid, organic phosphonic acid), organic acids such as citric acid, tartartic acid and malic acid, persulfates, and hydrogen peroxide can be advantageously used.

Particularly preferred among these bleaching agents are organic complex salts of iron (III) from the standpoint of rapid processing and environmental protection. Examples of aminopolycarboxylic acids, aminopolyphosphonic acids, organic phosphonic acids and salts thereof useful in the formation of organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycoletherdiaminetetraacetic acid. These compounds may be used in the form of the sodium salt, the potassium salt, the lithium salt or the ammonium salt. Preferred of these compounds are complexes of iron (III) with ethylenediaminetetraacetic acid, diethylenetriaminepentaacetic acid, cyclohexanediaminetetraacetic acid, 1,3-diaminopropanetetraacetic acid and methyliminodiacetic acid, which exhibit a high bleaching capacity. These ferric complexes may be used in the form of a complex salt. Alternatively, a ferric salt such as ferric sulfate, ferric chloride, ferric nitrate, ferric ammonium sulfate and ferric phosphate and a chelating agent such as aminopolycarboxylic acid, aminopolyphosphonic acid and phosphonocarboxylic acid may be used to form a ferric complex salt in solution. The chelating agent may-be used in an amount exceeding the value required to form the ferric complex salt. Preferred of these iron complexes are aminopolycarboxylic iron complexes. The content is in the range of 0.01 to 1.0 mol/l, preferably 0.05 to 0.50 mol/l.

For the details of bleaching solution and blix solution, reference can be made to Japanese Patent Application No. Hei. 3-255889.

The blix solution or fixing solution may comprise known fixing agents, i.e., thiosulfate such as sodium thiosulfate and ammonium thiosulfate, thiocyanate such as sodium thiocyanate and ammonium thiocyanate, thioether compounds such as ethylenebisthioglycolic acid and 3,6-dithia-1,8-octanediol, thioureas, nitrogen-containing heterocyclic compounds having a sulfido group, and silver halide solvents such as methoion compound and thioethers, alone or in admixture. The amount of the fixing agent is preferably in the range of 0.1 mol or more, 0.3 to 2.0 mol per l. The pH of the blix solution or fixing solution which can be used in the present invention is preferably in the range of 2 to 8, more preferably 3 to 5.

Further, the blix solution may contain various flurescent brightening agents, antifoaming agents or surface active agents or organic solvents such as polyvinyl pyrrolidone and methanol.

The blix solution or fixing solution may advantageously comprise a sulfite ion-releasing compound such as a sulfite (e.g., sodium sulfite, potassium sulfite, ammonium sulfite), a bisulfite (e.g., ammonium bisulfite, sodium bisulfite, potassium bisulfite) and a metabisulfite (e.g., potassium metabisulfite, sodium metabisulfite, ammonium metabisulfite). These compounds may be advantageously incorporated in the system in an amount of about 0.02 to 0.8 mol/l, more preferably 0.04 to 0.40 mol/l as calculated in terms of sulfite ion.

Further, ascorbic acid, sulfinic acid, carbonylbisulfite adducts or carbonyl compounds may be used.

Further, a buffer, a fluorescent brightening agent, a chelating agent, a mildew proofing agent or the like may be added to the system as desired.

In the blix step of the present invention, the processing time is in the range of 5 seconds to 120 seconds, preferably 60 seconds or less, particularly preferably 25 seconds or less. The processing temperature is in the range of 25° C. to 60° C., preferably 30° C. to 50° C. The replenishment rate is in the range of 20 ml to 250 ml, preferably 120 ml or less per $m^2$ of light-sensitive material. More preferably, the replenishment rate is in the range of 60 ml or less from the standpoint-of the-accomplishment of the effects of the present invention.

A further preferred embodiment of the processing step is processing without replenishment (replenished evaporatial loss of water content may be replenished).

The desilvering process such as fixing and blix is normally followed by washing and/or stabilization (washing includes stabilization hereinafter unless otherwise specified).

The amount of water to be used in the washing step can be selected from a broad range depending on the characteristics of the light-sensitive material (e.g., kind of couplers, etc.), the end use of the light-sensitive material, the temperature of the washing water, the number of washing tanks (number of stages), and various other factors. In general, the number of stages in a multi-stage countercurrent system is preferably 2 to 6, particularly 2 to 5.

According to the multi-stage countercurrent system, the amount of water required can be greatly reduced to, e.g., 0.5 l to 1 l per $m^2$ of light-sensitive material to remarkably accomplish the effects of the present invention. However, bacteria grow due to an increase in the retention time of water in the tank, and floating masses of bacteria adhere to the light-sensitive material. In the present invention, in order to cope with this problem, the method of reducing calcium and magnesium ion concentrations described in JP-A-62-288838 can be used very effectively. Further, isothiazolone compounds or thiabenzazoles as described in JP-A-57-8542, chlorine type bactericides, e.g., chlorinated sodium iso-cyanurate, as described in JP-A-61-120145, benzotriazole as described in JP-A-61-267761, and bactericides described in JP-A-61-267761 and copper ion can also be used.

The washing water may further contain a surface active agent as a hydro-extracting agent or a chelating agent such as EDTA as, a water softener.

The washing step may be followed by stabilization. Alternatively, stabilization without a washing step can be conducted. The stabilizing solution comprises a compound capable of stabilizing images. Examples of suitable compounds include aldehyde compounds such as formaldehyde, buffers for providing a film pH suitable for dye stabilization, and ammonium compounds. In order to inhibit proliferation of bacteria in solution or provide processed light-sensitive material with mildew proofing properties, the above mentioned various germicides or mildew proofing agents may be used.

Reference can be made to Japanese Patent Application No. Hei. 3-255889 for details of the stabilization step and the washing step for the light-sensitive material of the present invention.

The processing time of the present invention is defined by the time between the time when the light-sensitive material is brought into contact with the color developer and the time when the drying step is finished. The effects of the present invention can be remarkably accomplished in a rapid processing step which lasts 4 minutes or less, more generally 2 minutes or less.

The drying step which can be effected in the present invention is described hereinafter.

In order to effect the ultrarapid processing of the present invention to complete images, the drying time is preferably in the range of 20 seconds to 40 seconds.

Of reducing the drying time which can be used for the part of light-sensitive material involves reducing the amount of hydrophilic binder such as gelatin to reduce the amount of water content carried over into the film. Further, from the standpoint of reducing the amount of water brought over, it is also made possible to use a squeeze roller or cloth to absorb water from the light-sensitive material shortly after it leaves the washing bath, expediting drying. Also, drying can be expedited by increasing the temperature, or intensifying the drying air in the drying machine. Further, the angle at which drying air strikes the light-sensitive material can be adjusted or an appropriate method of evacuating the drying machine can be used to expedite drying.

The present invention is further described in the following examples, but the present invention should not be construed as being limited thereto.

EXAMPLE

Comparison Evaluation

Preparation of First Layer Coating Solution 153.0 g of a yellow coupler (ExY), 15.0 g of a dye stabilizer (Cpd-1), 7.5 g of a dye stabilizer (Cpd-2), and 16.0 g of a dye stabilizer (Cpd-3) were dissolved in a mixture of 25 g of a solvent (Solv-1) and 25 g of a solvent (Solv-2). The solution was then emulsion-dispersed in 1,000 g of a 10% aqueous solution of gelatin containing 60 cc of 10% sodium dodecylbenzenesulfonate and 10 g of citric acid to prepare an Emulsion Dispersion A. On the other hand, a silver bromochloride Emulsion A(3:7 (silver molar ratio) of a Large Size Emulsion A of cubic grains having an average grain size of 0.88 μm and a grain size distribution fluctuation coefficient of 0.08 and a Small Size Emulsion A of cubic grains having an average grain size of 0.70 μm and a grain size distribution fluctuation coefficient of 0.10, both emulsions comprising 0.3 mol % of silver bromide localized partially on the surface of grains) was prepared. This emulsion contained blue-sensitive sensitizing Dyes A and B in an amount of $2.0\times10^{-4}$ mol per mol of silver each for the Large Size Emulsion A and $2.5\times10^{-4}$ mol per mol of silver each for the Small Size Emulsion A. This emulsion was subjected to chemical ripening with a sulfur sensitizer and a gold sensitizer. Emulsion Dispersion A and the silver bromochloride Emulsion A were mixed to prepare a first layer coating solution having the composition shown below.

The coating solutions for the second layer to the seventh layer were prepared in the same manner as the coating solution for the first layer. The sodium salt of 1-oxy-3,5-dichloro-s-triazine was used as a gelatin hardener for each layer.

To these layers were each added Cpd-14 and Cpd-15 in a total amount of 25.0 mg/$m^2$ and 50.0 mg/$m^2$, respectively.

The silver bromochloride emulsion in these light-sensitive emulsion layers comprised the following spectral sensitizing dyes:

Blue-Sensitive Emulsion Layer

Sensitizing Dye A

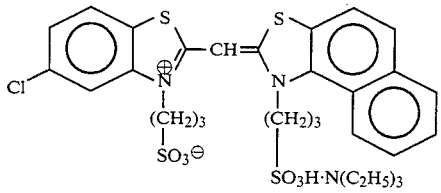

and

Sensitizing Dye B

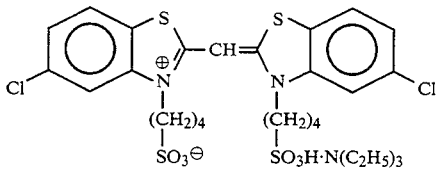

($2.0 \times 10^{-4}$ mol per mol of silver halide each for the large size emulsion and $2.5 \times 10^{-4}$ mol per mol of silver halide each for the small size emulsion)

Green-Sensitive Emulsion Layer

Sensitizing Dye C

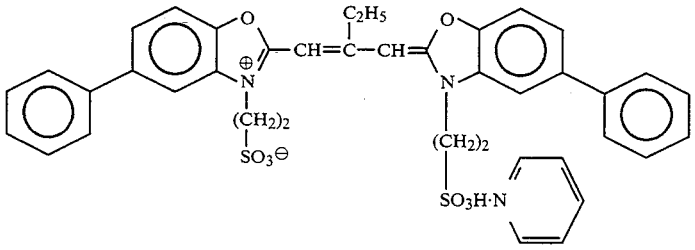

($4.0 \times 10^{-4}$ mol per mol of silver halide for the large size emulsion and $5.6 \times 10^{-4}$ mol per mol of silver halide for the small size emulsion)

Sensitizing Dye D

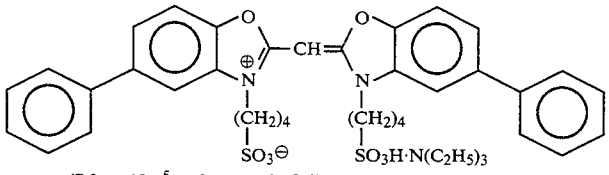

($7.0 \times 10^{-5}$ mol per mol of silver halide for the large size emulsion and $1.0 \times 10^{-5}$ mol per mol of silver halide for the small size emulsion)

Further, the following compound was incorporated in an amount of $2.6 \times 10^{-3}$ mol per mol of silver halide.

Red-Sensitive Emulsion Layer

Sensitizing Dye E

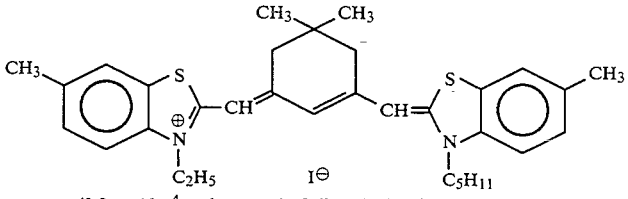

($0.9 \times 10^{-4}$ mol per mol of silver halide for the large size emulsion and $1.1 \times 10^{-4}$ mol per mol of silver halide for the small emulsion)

yl-1,3,3a,7-tetrazaindene in an amount of $1\times10^{-4}$ mol and $2\times10^{-4}$ mol per mol of silver halide, respectively.

In order to inhibit irradiation, to these emulsion layers were each added the following dyes (numerals in parenthesis indicate the coated amount):

(10 mg/m²)

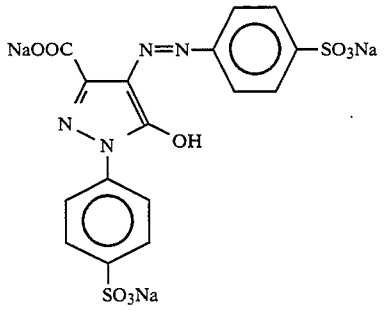

(10 mg/m²)

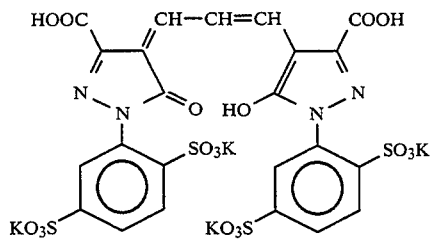

(40 mg/m²)

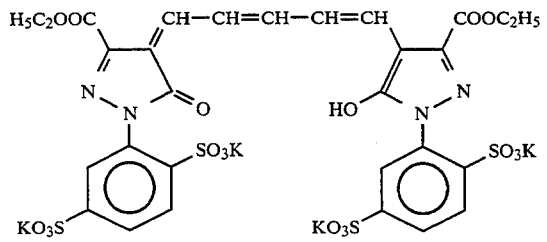

and (20 mg/m²)

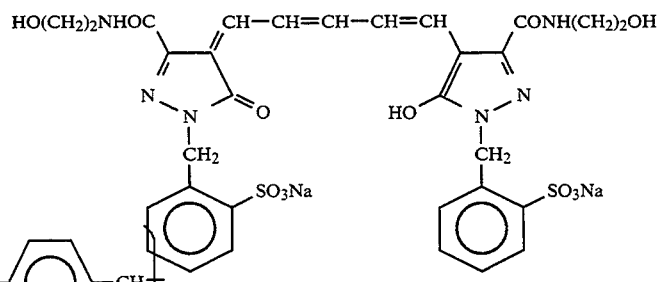

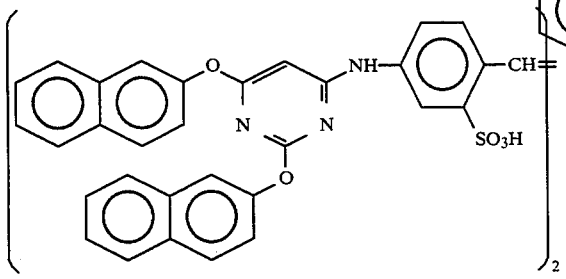

To the blue-sensitive emulsion layer, green-sensitive emulsion layer and red-sensitive emulsion layer was each added 1-(5μmethylureidophenyl) -5-mercaptotetrazole in an amount of $8.5\times10^{-5}$ mol, $7.7\times10^{-4}$ mol and $2.5\times10^{-4}$ mol per mol of silver halide, respectively.

To the blue-sensitive emulsion layer and green-sensitive emulsion layer was each added 4-hydroxy-6-meth- Layer Formation The formulations of the various layers are set forth below. The figures indicate the coated amount (g/m²). The coated amount of silver halide emulsion is represented in terms of silver.

Support

Polyethylene-laminated paper [containing a white pigment ($TiO_2$) and a bluish dye (ultramarine) in polyethylene on the first layer side]

| First Layer (blue-sensitive emulsion layer) | |
|---|---|
| Above described silver bromochloride emulsion A | 0.27 |
| Gelatin | 1.36 |
| Yellow coupler (ExY) | 0.79 |
| Dye image stabilizer (Cpd-1) | 0.08 |

-continued

| | |
|---|---|
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second Layer (color stain inhibiting layer) | |
| Gelatin | 1.00 |
| Color stain inhibitor (Cpd-4) | 0.06 |
| Solvent (Solv-7) | 0.03 |
| Solvent (Solv-2) | 0.25 |
| Solvent (Solv-3) | 0.25 |
| Third Layer (green-sensitive emulsion layer) | |
| Silver bromochloride emulsion (1:3 (Ag molar ratio) mixture of a large size Emulsion B of cubic grains having an average size of 0.55 μm with a grain size distribution fluctuation coefficient of 0.10 and a small size Emulsion B of cubic grains having an average size of 0.39 μm with a grain size distribution fluctuation coefficient of 0.08, 0.8 mol % of silver bromide localized partially on the surface of each emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color stain inhibiting layer) | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |

-continued

| | |
|---|---|
| Fifth Layer (red-sensitive emulsion layer) | |
| Silver bromochloride emulsion (1:4 (Ag molar ratio) mixture of a large size Emulsion C of cubic grains having an average size of 0.50 μm with a grain size distribution fluctuation coefficient of 0.09 and a small size Emulsion C of cubic grains having an average size of 0.41 μm with a grain size distribution fluctuation coefficient of 0.11, 0.8 mol % of silver bromide localized partially on the surface of each emulsion) | 0.18 |
| Gelatin | 0.80 |
| Cyan coupler (ExC) | 0.33 |
| Dye image stabilizer (Cpd-1) | 0.35 |
| Ultraviolet absorbent (UV-2) | 0.18 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Sixth layer (ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| Seventh layer (protective layer) | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

The chemical structure of the compounds present in these layers are set forth below.

Yellow Coupler (ExY)

1:1 (molar ratio) mixture of

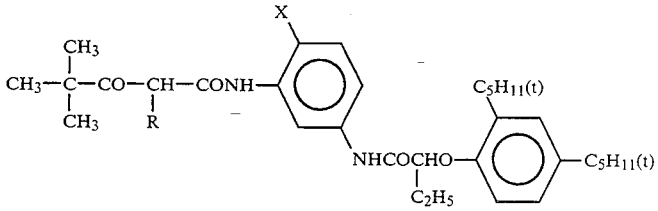

R =

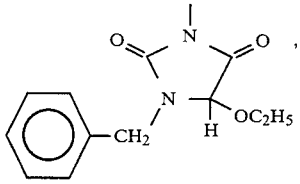

, X = Cl and

R =

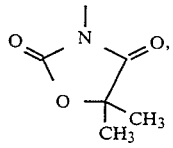

, X = $OCH_3$

Magenta Coupler (ExM)

-continued
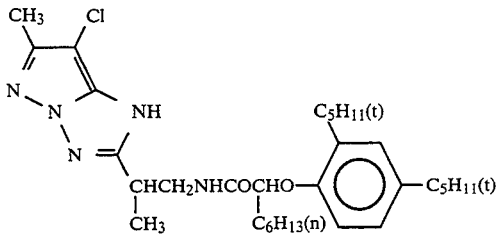
Cyan Coupler (ExC)
3:7 mixture (molar ratio) of:
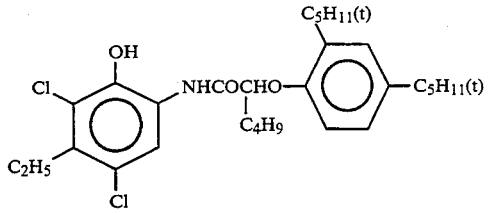
and
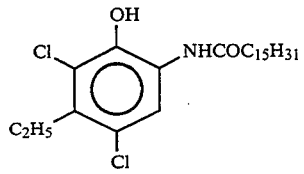
Dye Image Stabilizer (Cpd-1)
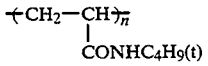
(Average molecular weight: 60,000)
Dye Image Stabilizer (Cpd-2)
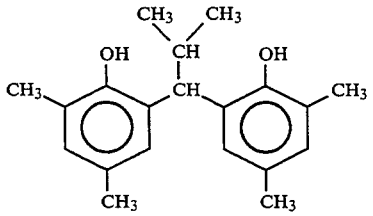
Dye Image Stabilizer (Cpd-3)
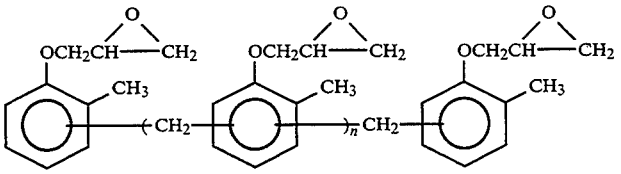
n = 7-8 (on average)
Color Stain Inhibitor (Cpd-4)
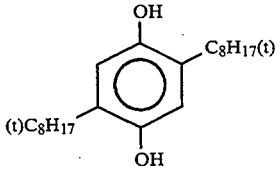
Dye Image Stabilizer (Cpd-5)

-continued
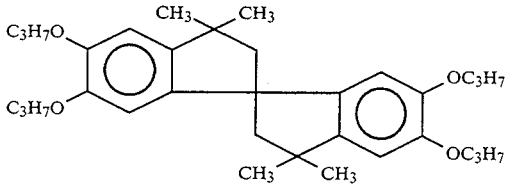
Dye Image Stabilizer (Cpd-6)
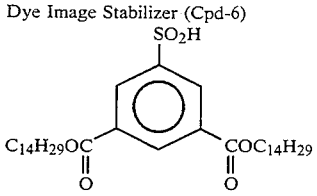
Dye Image Stabilizer (Cpd-7)
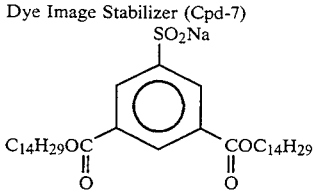
Dye Image Stabilizer (Cpd-8)
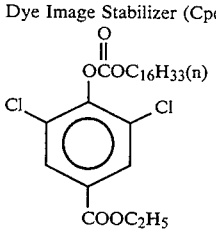
Dye Image Stabilizer (Cpd-9)
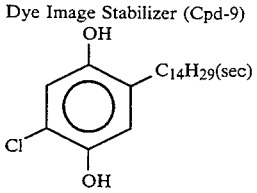
Dye Image Stabilizer (Cpd-10)
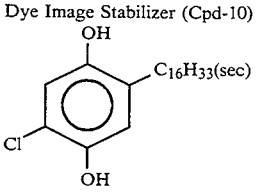
Dye Image Stabilizer (Cpd-11)
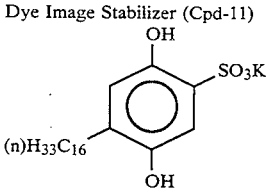
Dye Image Stabilizer (Cpd-12)
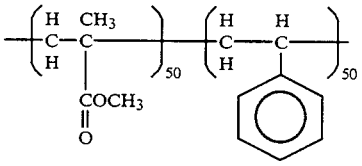
Average molecular weight: 60,000

-continued
Dye Image Stabilizer (Cpd-13)
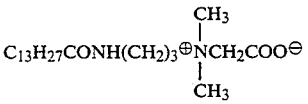
Preservative (Cpd-14)
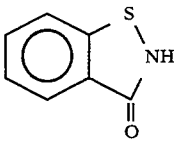
Preservative (Cpd-15)
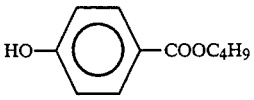
Ultraviolet Absorbent (UV-1)
10:5:1:5 (weight ratio) mixture of:
(i)
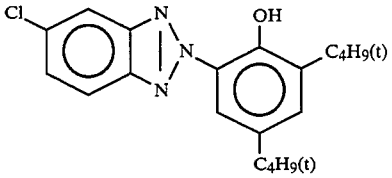
(ii)
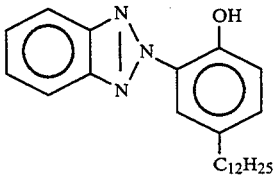
(iii)
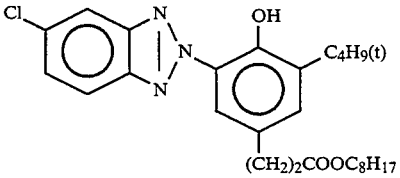
and
(iv)
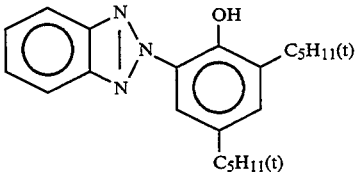
Ultraviolet Absorbent (UV-2)
1:2:2 mixture (weight ratio) of:
(1)
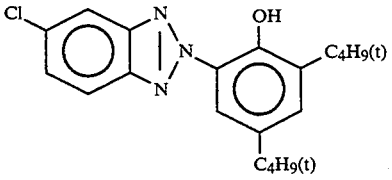

-continued (2)

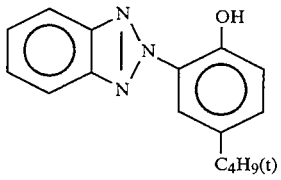

and (3)

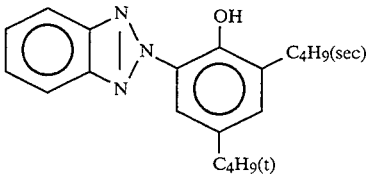

Solvent (Solv-1)

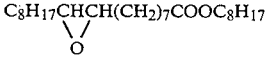

Solvent (Solv-2)

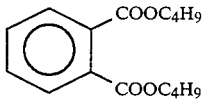

Solvent (Solv-3)

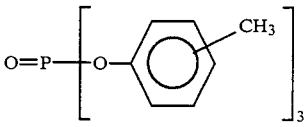

Solvent (Solv-4)

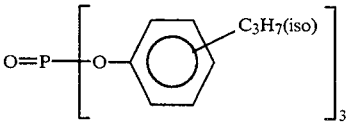

Solvent (Solv-5)

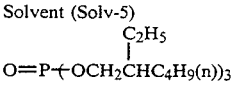

Solvent (Solv-6)

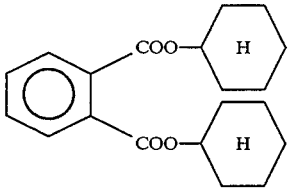

Solvent (Solv-7)

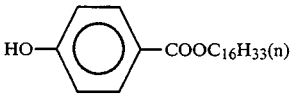

The light-sensitive material samples thus prepared were each slit, and then gradationwise exposed to light through a three color separation filter for sensitometry using a sensitometer (Type FW produced by Fuji Photo Film Co., Ltd.; color temperature of light source: 3,200° K.). The samples which had been exposed were then processed in the following processing steps. Another batch of these samples was exposed to white light, and then similarly processed.

| Processing Step | Temperature | Time |
|---|---|---|
| Color Development | 38° C. | 20 sec. |
| Blix | 38° C. | 20 sec. |

-continued

| Processing Step | Temperature | Time |
|---|---|---|
| Rinse 1 | 38° C. | 5 sec. |
| Rinse 2 | 38° C. | 5 sec. |
| Rinse 3 | 38° C. | 5 sec. |
| Rinse 4 | 38° C. | 5 sec. |
| Rinse 5 | 38° C. | 10 sec. |
| Drying | 60–80° C. | 15 sec. |

(The rinse step was effected in a countercurrent manner wherein the washing water flowed backward.)

The washing water in Rinse 5 was pumped through a reverse osmosis membrane. The washing water which had permeated through the reverse osmosis membrane was supplied into Rinse 5 while the concentrated water which had not permeated through the reverse osmosis membrane was returned to Rinse 4 for use.

The various processing solutions had the following compositions:

| | Running solution |
|---|---|
| Color Developer | |
| Water | 700 ml |
| Ethylenediaminetetraacetic acid | 1.5 g |
| Sodium triisopropylnaphthalene(β) sulfonate | 0.01 g |
| Disodium 1,2-dihydroxybenzene-4,6-disulfonate | 0.25 g |
| Triethanolamine | 5.8 g |
| Potassium chloride | 5.0 g |
| Potassium bromide | 0.01 g |
| Potassium carbonate | 30.0 g |
| Sodium hydrogencarbonate | 5.3 g |
| Fluorescent brightening agent (UVITEX CK, available from Ciba Geigy) | 2.5 g |
| Sodium sulfite | 0.14 g |
| Disodium-N,N-bis(sulfonatoethyl) hydroxylamine | 7.4 g |
| Color developing agent (set forth in Table A below) | 20 mmol |
| Water to make | 1,000 ml |
| pH (25° C.) | 10.05 |
| Blix Solution | |
| Water | 600 ml |
| Ammonium thiosulfate (70% aq. solu.) | 100 ml |
| Ammonium sulfite | 40 g |
| Ferric ammonium ethylenediamine-tetraacetate | 77 g |
| Disodium ethylenediaminetetraacetate | 5 g |
| Armnonium chloride | 42 g |
| Water to make | 1,000 ml |
| pH (25° C.) (adjusted with acetic acid and aqueous ammonia) | 5.5 |

The replenisher had the same composition as above, except that the pH value of the tank solution was adjusted to 5.0.

Rinse Solution

Ion-exchange water (calcium and magnesium concentrations each adjusted to 3 ppm or less)

Evaluation of Image Density

The minimum density (Dmin) and maximum density (Dmax) of the yellow, magenta and cyan images thus obtained were measured through B, G and R filters corresponding to the respective dyes. These samples were exposed to a xenon light (300,000 lux) for 8 days, and then the image density drop due to irradiation with light was measured.

(Density after fading (FD): density of irradiated image on the exposed portion giving an image density of 1.0)

Evaluation of Resolving Power and Image Stain

The processed samples (films exposed to light through a resolving power chart) were stored in a constant humidity and temperature bath conditioned to 85% at 70° C. for 15 days, and then the minimum yellow density was measured. Thus, the increase in the yellow density from that before storage was determined as ΔDmin.

After storage, the cyan image was observed to have run. The degree of running was visually evaluated.

Resolving Power: 5 lines or more/mm: Excellent
2 to 5 lines/mm: Fair
2 lines or less/mm: Poor The results obtained are set forth in Table A below.

TABLE A

| Sample No./Color Developing Agent | B | | | G | | | R | | | | Resolving |
|---|---|---|---|---|---|---|---|---|---|---|---|
| | Dmax | Dmin | FD | Dmax | Dmin | FD | Dmax | Dmin | FD | ΔDmin | Power |
| ¼-Amino-3-methyl-N-ethyl-N-[β-(methanesulfonamide)ethyl]-aniline 3/2 sulfate monohydrate | 1.62 | 0.07 | 0.92 | 2.41 | 0.06 | 0.88 | 2.50 | 0.13 | 0.86 | 0.16 | Fair |
| 2/4-Amino-3-methyl-N-ethyl-N-(β-hydroxyethyl)-aniline sulfate | 2.20 | 0.07 | 0.70 | 2.43 | 0.06 | 0.62 | 2.54 | 0.13 | 0.72 | 0.06 | Poor |
| ¾-Amino-3-methyl-N-ethyl-N-(4-hydroxybutyl) aniline diparatoluenesulfonate | 2.35 | 0.07 | 0.93 | 2.43 | 0.06 | 0.92 | 2.54 | 0.13 | 0.92 | 0.12 | Poor |

As shown by the results in Table A above, as a result of the study with the variation of the kind of p-phenylenediamine derivative, it was found that only the exemplified compound provides a dye image with a sufficient Dmax and a high light fastness in a short processing time of 20 seconds. However, all these samples were observed to show a stain increase and image running.

EXAMPLE 1

Color photographic light-sensitive materials were prepared in the same manner as in the comparison example, except that the-cyan coupler to be incorporated in the Fifth Layer (red-sensitive layer) was replaced by those set forth in Table B, respectively, below.

These samples were exposed to light, and then subjected to continuous processing (running test) with the color developer described below in the following processing steps until the color developer lank was entirely replenished. Another batch of samples was subjected to the same test as conducted in the comparison test.

| Processing Step | Temperature | Time | Replenisher* | Tank Capacity |
|---|---|---|---|---|
| Color Development | 40° C. | 15 sec. | 35 ml | 2 l |
| Blix | 40° C. | 15 sec. | 35 ml | 2 l |
| Rinse 1 | 40° C. | 3 sec. | — | 1 l |
| Rinse 2 | 40° C. | 3 sec. | — | 1 l |
| Rinse 3 | 40° C. | 3 sec. | — | 1 l |
| Rinse 4 | 40° C. | 3 sec. | — | 1 l |
| Rinse 5 | 40° C. | 6 sec. | 60 ml | 1 l |
| Drying | 60–80° C. | 15 sec. | | |

*The replenishment rate is represented per $m^2$ of light-sensitive material. The rinse step was effected in a countercurrent process wherein the washing water flowed backward.

The washing water in Rinse 5 was pumped through a reverse osmosis membrane. The washing water which had permeated through the reverse osmosis membrane was supplied into Rinse 5 while the concentrated water which had not permeated through the reverse osmosis membrane was returned to Rinse 4 for use. In order to reduce the crossover time between the rinse steps, the washing water was passed through a blade disposed between the tanks.

The color developer lad the following composition:

| Color Developer | Running Solution | Replenisher |
|---|---|---|
| Water | 700 ml | 700 ml |
| Ethylenediaminetetraacetic acid | 1.5 g | 3.75 g |
| Sodium triisopropylnaphthalene(β) sulfonate | 0.01 g | 0.01 g |
| Disodium 1,2-dihydroxybenzene-4,6-disulfonate | 0.25 g | 0.7 g |
| Triethanolamine | 5.8 g | 14.5 g |
| Potassium chloride | 10.0 g | — |
| Potassium bromide | 0.03 g | — |
| Potassium carbonate | 30.0 g | 39.0 g |
| Sodium hydrogencarbonate | 5.3 g | — |
| Fluorescent brightening agent (UVITEX CK, available from Ciba Geigy) | 2.5 g | 5.0 g |
| Sodium sulfite | 0.14 g | 0.2 g |
| Disodium N,N-bis(sulfonatoethyl) hydroxylamine | 7.4 g | 15.0 g |
| 4-Amino-3-methyl-N-ethyl-N-(4-hydroxybutyl)aniline di-p-toluenesulfonate | 14.5 g | 35.0 g |
| Water to make | 1,000 ml | 1,000 ml |
| pH (25° C.) | 10.05 | 11.60 |

The results obtained are set forth in Table B below.

TABLE B

| Sample No./Cyan Coupler | ΔDmin | Resolving power |
|---|---|---|
| 4/same as in Example 1 (comparative) | 0.12 | Poor |
| 5/C-1 (present invention) | 0.06 | Excellent |
| 6/C-2 (present invention) | 0.06 | Excellent |
| 7/C-3 (present invention) | 0.05 | Excellent |
| 8/C-19 (present invention) | 0.05 | Excellent |
| 9/C-36 (present invention) | 0.07 | Excellent |

As shown by the results in Table B, the use of the cyan coupler of the present invention prevents the cyan image from running-as observed in the comparison test and less stain occurs.

The samples of the present invention exhibited almost the same excellent Dmax and image fastness to light as Sample No. 3 of the comparative test.

It also can be seen that even the infrared-sensitive silver halide color photographic material which has been similarly processed provides an image which does not run and little stain occurs.

EXAMPLE 2

A color photographic light-sensitive material samples was prepared in the same manner as in the comparison test, except that the cyan coupler incorporated in the Fifth Layer (red-sensitive layer) was replaced by C-1.

The sample was then processed in the same manner as in the comparison test, except that the developing agent was altered as set forth in Table C below.

The results obtained are set forth in Table C below.

TABLE C

| Sample No./Color Developing Agent | ΔDmin | Resolving Power |
|---|---|---|
| 10/D-2 | 0.06 | Excellent |
| 11/D-7 | 0.05 | Excellent |
| 12/D-13 | 0.05 | Excellent |
| 13/D-16 | 0.06 | Excellent |
| 14/D-17 | 0.07 | Fair |
| 15/D-18 | 0.12 | Fair |

The results in table C show that the present invention enables the expedition of processing while providing an image with an excellent dye stability.

In accordance with the present invention, a photographic light-sensitive material comprising a cyan coupler represented by the general formula (I) or (II) is processed with a specific color developing agent represented by the general formula (III) to form a dye which exhibits excellent coloring properties with little stain occurring and provides an excellent resolving power even after prolonged storage.

The same excellent results can be obtained also in an ultrarapid development process and low replenishment processing.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material comprising a support having thereon at least a silver halide emulsion layer containing a cyan dye-forming coupler, a silver halide emulsion layer containing a magenta dye-forming coupler, and a silver halide emulsion layer containing a yellow dye-forming coupler;

wherein the silver halide color photographic material contains at least one cyan dye-forming coupler represented by the following general formula (I) or (II) in said silver halide emulsion layer containing said cyan dye-forming coupler; and wherein said processing comprises color developing said imagewise exposed silver halide color photographic material with a color developer containing a p-phenylenediamine derivative represented by the following general formula (III):

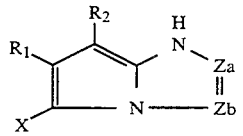

(I)

-continued (II)

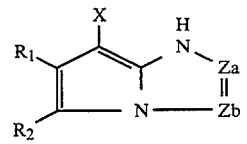

wherein Za and Zb each represents —C($R_3$)= or —N=, with the proviso that one of Za and Zb is —N= and the other is —C($R_3$)=; $R_1$ and $R_2$ each represents an electrophilic group having a Hammett's substituent constant $\sigma_p$ of 0.02 or more, with the proviso that the sum of $\sigma_p$ of $R_1$ and $R_2$ is 0.65 or more; $R_3$ represents a hydrogen atom or a substituent; X represents a hydrogen atom or a group capable of being released upon coupling with an oxidation product of an aromatic primary amine color developing agent; and $R_1$, $R_2$, $R_3$ or X may be a divalent group with the compound being a dimer or higher polymer or part of a high molecular weight chain as a homo polymer or copolymer;

(III)

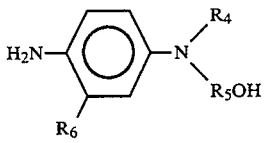

wherein $R_4$ represents a $C_{1-6}$ straight-chain or branched alkyl group or a $C_{3-6}$ straight-chain or branched hydroxyalkyl group; $R_5$ represents a $C_{3-6}$ straight-chain or branched alkylene group or a $C_{3-6}$ straight-chain or branched hydroxyalkylene group; and $R_6$ represents a hydrogen atom, a $C_{1-4}$ straight-chain or branched alkyl group or a $C_{1-4}$ straight-chain or branched alkoxy group.

2. The method as in claim 1, wherein said processing comprises color developing, blixing and drying; the processing time of said photographic material comprises 25 seconds or less for the blix step, and the time between the beginning of development step and the completion of drying step for said photographic material comprises 120 seconds or less.

3. The method as in claim 1, wherein said cyan dye-forming coupler is represented by the following general formula (I-a) or (I-b)

(I-a)

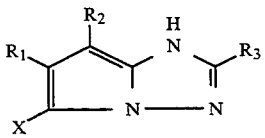

(I-b)

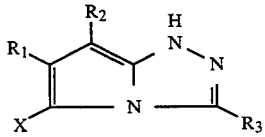

wherein $R_1$, $R_2$, $R_3$ and X are as defined in the general formula (I).

4. The method as in claim 1, wherein said cyan dye-forming coupler is represented by the following general formula (II-a) or (II-b)

(II-a)

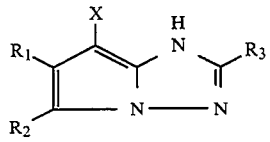

(II-b)

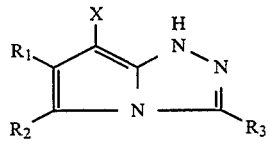

wherein $R_1$, $R_2$, $R_3$ and X are as defined in the general formula (II).

5. The method as in claim 1, wherein $R_1$ and $R_2$ each represents an electrophilic group having the Hammett's substituent constant $\sigma_p$ of 0.2 to 1.0.

6. The method as in claim 5, wherein $R_1$ and $R_2$ each represents an electrophilic group having the Hammett's substituent constant $\sigma_p$ of 0.3 to 1.0.

7. The method as in claim 1, wherein the sum of $\sigma_p$ of $R_1$ and $R_2$ is within the range of 0.65 to 1.8.

8. The method as in claim 7, wherein the sum of $\sigma_p$ of $R_1$ and $R_2$ is within the range of 0.7 to 1.8.

9. The method as in claim 1, wherein said substituent represented by $R_3$ is selected from the group consisting of a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group, and an azolyl group.

10. The method as in claim 9, wherein said substituent represented by $R_3$ is selected from the group consisting of an alkyl group, an aryl group, a heterocyclic group, a cyano group, a nitro group, an acylamino group, a anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

11. The method as in claim 10, wherein said substituent represented by $R_3$ is an alkyl group or an aryl group.

12. The method as in claim 1, wherein $R_5$ represents a $C_{3-4}$ straight-chain or branched alkylene group.

* * * * *